US011817655B2

(12) United States Patent
Liu et al.

(10) Patent No.: US 11,817,655 B2
(45) Date of Patent: Nov. 14, 2023

(54) COMPACT, HIGH SPEED ELECTRICAL CONNECTOR

(71) Applicant: Amphenol Commercial Products (Chengdu) Co., Ltd., Chengdu (CN)

(72) Inventors: Yunxiang Liu, Chengdu (CN); Lei Liao, Shenzhen (CN); Luyun Yi, Chengdu (CN)

(73) Assignee: Amphenol Commercial Products (Chengdu) Co., Ltd., Chengdu (CN)

( * ) Notice: Subject to any disclaimer, the term of this patent is extended or adjusted under 35 U.S.C. 154(b) by 124 days.

(21) Appl. No.: 17/477,352

(22) Filed: Sep. 16, 2021

(65) Prior Publication Data

US 2022/0102916 A1 Mar. 31, 2022

(30) Foreign Application Priority Data

Sep. 25, 2020 (CN) ..... 202022135407.9

(51) Int. Cl.
*H01R 13/6471* (2011.01)
*H01R 43/20* (2006.01)
*H01R 13/502* (2006.01)

(52) U.S. Cl.
CPC ..... *H01R 13/6471* (2013.01); *H01R 13/502* (2013.01); *H01R 43/20* (2013.01)

(58) Field of Classification Search
CPC .. H01R 13/504; H01R 13/646; H01R 13/652; H01R 13/6471; H01R 13/6597; H01R 13/6599; H01R 24/60; H01R 12/712; H01R 12/716; H01R 12/721; H01R 12/724; H01R 12/727; H01R 12/73
USPC ..... 439/634, 65, 86, 90, 101, 636, 637, 439/607.02
See application file for complete search history.

(56) References Cited

U.S. PATENT DOCUMENTS

| | | | |
|---|---|---|---|
| 2,996,710 | A | 8/1961 | Pratt |
| 3,002,162 | A | 9/1961 | Garstang |
| 3,134,950 | A | 5/1964 | Cook |
| 3,243,756 | A | 3/1966 | Ruete et al. |
| 3,322,885 | A | 5/1967 | May et al. |
| 3,390,369 | A | 6/1968 | Zavertnik et al. |

(Continued)

FOREIGN PATENT DOCUMENTS

| | | | |
|---|---|---|---|
| CN | 1075390 | A | 8/1993 |
| CN | 1098549 | A | 2/1995 |

(Continued)

OTHER PUBLICATIONS

Chinese Invalidation Request dated Aug. 17, 2021 in connection with Chinese Application No. 200580040906.5.

(Continued)

*Primary Examiner* — Marcus E Harcum
(74) *Attorney, Agent, or Firm* — Wolf, Greenfield & Sacks, P.C.

(57) ABSTRACT

An electrical connector including a front housing member, signal and ground terminals disposed in a row in the front housing member, a cover member mounted to a rear of the front housing member, and a lossy member disposed in the cover member and contacting the ground terminals. Such a configuration improves signal integrity of the electronical connector while simplifying the manufacture and assembly of the electrical connector and reducing the cost thereof.

20 Claims, 12 Drawing Sheets

(56) References Cited

U.S. PATENT DOCUMENTS 3,390,389 A 6/1968 Bluish
3,505,619 A 4/1970 Bishop
3,573,677 A 4/1971 Detar
3,731,259 A 5/1973 Occhipinti
3,743,978 A 7/1973 Fritz
3,745,509 A 7/1973 Woodward et al.
3,786,372 A 1/1974 Epis et al.
3,825,874 A 7/1974 Peverill
3,848,073 A 11/1974 Simons et al.
3,863,181 A 1/1975 Glance et al.
3,999,830 A 12/1976 Herrmann, Jr. et al.
4,155,613 A 5/1979 Brandeau
4,175,821 A 11/1979 Hunter
4,195,272 A 3/1980 Boutros
4,215,910 A 8/1980 Walter
4,272,148 A 6/1981 Knack, Jr.
4,276,523 A 6/1981 Boutros et al.
4,371,742 A 2/1983 Manly
4,408,255 A 10/1983 Adkins
4,447,105 A 5/1984 Ruehl
4,457,576 A 7/1984 Cosmos et al.
4,471,015 A 9/1984 Ebneth et al.
4,472,765 A 9/1984 Hughes
4,484,159 A 11/1984 Whitley
4,490,283 A 12/1984 Kleiner
4,518,651 A 5/1985 Wolfe, Jr.
4,519,664 A 5/1985 Tillotson
4,519,665 A 5/1985 Althouse et al.
4,571,014 A 2/1986 Robin et al.
4,605,914 A 8/1986 Harman
4,607,907 A 8/1986 Bogursky
4,632,476 A 12/1986 Schell
4,636,752 A 1/1987 Saito
4,655,518 A 4/1987 Johnson et al.
4,674,812 A 6/1987 Thom et al.
4,678,260 A 7/1987 Gallusser et al.
4,682,129 A 7/1987 Bakermans et al.
4,686,607 A 8/1987 Johnson
4,728,762 A 3/1988 Roth et al.
4,737,598 A 4/1988 O'Connor
4,751,479 A 6/1988 Parr
4,761,147 A 8/1988 Gauthier
4,806,107 A 2/1989 Arnold et al.
4,824,383 A 4/1989 Lemke
4,836,791 A 6/1989 Grabbe et al.
4,846,724 A 7/1989 Sasaki et al.
4,846,727 A 7/1989 Glover et al.
4,871,316 A 10/1989 Herrell et al.
4,876,630 A 10/1989 Dara
4,878,155 A 10/1989 Conley
4,889,500 A 12/1989 Lazar et al.
4,902,243 A 2/1990 Davis
4,948,922 A 8/1990 Varadan et al.
4,970,354 A 11/1990 Iwasa et al.
4,971,726 A 11/1990 Maeno et al.
4,975,084 A 12/1990 Fedder et al.
4,984,992 A 1/1991 Beamenderfer et al.
4,992,060 A 2/1991 Meyer
5,000,700 A 3/1991 Masubuchi et al.
5,046,084 A 9/1991 Barrett et al.
5,046,952 A 9/1991 Cohen et al.
5,046,960 A 9/1991 Fedder
5,066,236 A 11/1991 Broeksteeg
5,135,405 A 8/1992 Fusselman et al.
5,141,454 A 8/1992 Garrett et al.
5,150,086 A 9/1992 Ito
5,166,527 A 11/1992 Solymar
5,168,252 A 12/1992 Naito
5,168,432 A 12/1992 Murphy et al.
5,176,538 A 1/1993 Hansell, III et al.
5,190,472 A 3/1993 Voltz et al.
5,246,388 A 9/1993 Collins et al.
5,259,773 A 11/1993 Champion et al.
5,266,055 A 11/1993 Naito et al.
5,280,257 A 1/1994 Cravens et al.
5,281,762 A 1/1994 Long et al.
5,287,076 A 2/1994 Johnescu et al.
5,323,299 A 6/1994 Weber
5,334,050 A 8/1994 Andrews
5,335,146 A 8/1994 Stucke
5,340,334 A 8/1994 Nguyen
5,346,410 A 9/1994 Moore, Jr.
5,352,123 A 10/1994 Sample et al.
5,403,206 A 4/1995 McNamara et al.
5,407,622 A 4/1995 Cleveland et al.
5,429,520 A 7/1995 Morlion et al.
5,429,521 A 7/1995 Morlion et al.
5,433,617 A 7/1995 Morlion et al.
5,433,618 A 7/1995 Morlion et al.
5,456,619 A 10/1995 Belopolsky et al.
5,461,392 A 10/1995 Mott et al.
5,474,472 A 12/1995 Niwa et al.
5,484,310 A 1/1996 McNamara et al.
5,490,372 A 2/1996 Schlueter
5,496,183 A 3/1996 Soes et al.
5,499,935 A 3/1996 Powell
5,539,148 A 7/1996 Konishi et al.
5,551,893 A 9/1996 Johnson
5,554,050 A 9/1996 Marpoe, Jr.
5,562,497 A 10/1996 Yagi et al.
5,564,949 A 10/1996 Wellinsky
5,571,991 A 11/1996 Highum et al.
5,597,328 A 1/1997 Mouissie
5,605,469 A 2/1997 Wellinsky et al.
5,620,340 A 4/1997 Andrews
5,651,702 A 7/1997 Hanning et al.
5,660,551 A 8/1997 Sakurai
5,669,789 A 9/1997 Law
5,702,258 A 12/1997 Provencher et al.
5,755,597 A 5/1998 Panis et al.
5,795,191 A 8/1998 Preputnick et al.
5,796,323 A 8/1998 Uchikoba et al.
5,803,768 A 9/1998 Zell et al.
5,831,491 A 11/1998 Buer et al.
5,833,486 A 11/1998 Shinozaki
5,833,496 A 11/1998 Hollander et al.
5,842,887 A 12/1998 Andrews
5,870,528 A 2/1999 Fukuda
5,885,095 A 3/1999 Cohen et al.
5,887,158 A 3/1999 Sample et al.
5,904,594 A 5/1999 Longueville et al.
5,924,899 A 7/1999 Paagman
5,931,686 A 8/1999 Sasaki et al.
5,959,591 A 9/1999 Aurand
5,961,355 A 10/1999 Morlion et al.
5,971,809 A 10/1999 Ho
5,980,321 A 11/1999 Cohen et al.
5,981,869 A 11/1999 Kroger
5,982,253 A 11/1999 Perrin et al.
5,993,259 A 11/1999 Stokoe et al.
5,997,361 A 12/1999 Driscoll et al.
6,019,616 A 2/2000 Yagi et al.
6,042,394 A 3/2000 Mitra et al.
6,083,047 A 7/2000 Paagman
6,102,747 A 8/2000 Paagman
6,116,926 A 9/2000 Ortega et al.
6,120,306 A 9/2000 Evans
6,123,554 A 9/2000 Ortega et al.
6,132,255 A 10/2000 Verhoeven
6,132,355 A 10/2000 Derie
6,135,824 A 10/2000 Okabe et al.
6,146,202 A 11/2000 Ramey et al.
6,152,274 A 11/2000 Blard et al.
6,152,742 A 11/2000 Cohen et al.
6,152,747 A 11/2000 McNamara
6,163,464 A 12/2000 Ishibashi et al.
6,168,469 B1 1/2001 Lu
6,171,115 B1 1/2001 Mickievicz et al.
6,171,149 B1 1/2001 van Zanten
6,174,202 B1 1/2001 Mitra
6,174,203 B1 1/2001 Asao
6,174,944 B1 1/2001 Chiba et al.
6,179,651 B1 1/2001 Huang
6,179,663 B1 1/2001 Bradley et al.

(56) References Cited

U.S. PATENT DOCUMENTS

| | | | |
|---|---|---|---|
| 6,196,853 | B1 | 3/2001 | Harting et al. |
| 6,203,396 | B1 | 3/2001 | Asmussen et al. |
| 6,206,729 | B1 | 3/2001 | Bradley et al. |
| 6,210,182 | B1 | 4/2001 | Elco et al. |
| 6,210,227 | B1 | 4/2001 | Yamasaki et al. |
| 6,217,372 | B1 | 4/2001 | Reed |
| 6,227,875 | B1 | 5/2001 | Wu et al. |
| 6,231,391 | B1 | 5/2001 | Ramey et al. |
| 6,238,245 | B1 | 5/2001 | Stokoe et al. |
| 6,267,604 | B1 | 7/2001 | Mickievicz et al. |
| 6,273,758 | B1 | 8/2001 | Lloyd et al. |
| 6,293,827 | B1 | 9/2001 | Stokoe |
| 6,296,496 | B1 | 10/2001 | Trammel |
| 6,299,438 | B1 | 10/2001 | Sahagian et al. |
| 6,299,483 | B1 | 10/2001 | Cohen et al. |
| 6,299,484 | B2 | 10/2001 | Van Woensel |
| 6,299,492 | B1 | 10/2001 | Pierini et al. |
| 6,328,572 | B1 | 12/2001 | Higashida et al. |
| 6,328,601 | B1 | 12/2001 | Yip et al. |
| 6,333,468 | B1 | 12/2001 | Endoh et al. |
| 6,343,955 | B2 | 2/2002 | Billman et al. |
| 6,343,957 | B1 | 2/2002 | Kuo et al. |
| 6,347,962 | B1 | 2/2002 | Kline |
| 6,350,134 | B1 | 2/2002 | Fogg et al. |
| 6,358,088 | B1 | 3/2002 | Nishio et al. |
| 6,358,092 | B1 | 3/2002 | Siemon et al. |
| 6,364,711 | B1 | 4/2002 | Berg et al. |
| 6,364,713 | B1 | 4/2002 | Kuo |
| 6,375,510 | B2 | 4/2002 | Asao |
| 6,379,188 | B1 | 4/2002 | Cohen et al. |
| 6,380,485 | B1 | 4/2002 | Beaman et al. |
| 6,392,142 | B1 | 5/2002 | Uzuka et al. |
| 6,394,839 | B2 | 5/2002 | Reed |
| 6,396,712 | B1 | 5/2002 | Kuijk |
| 6,398,588 | B1 | 6/2002 | Bickford |
| 6,409,543 | B1 | 6/2002 | Astbury, Jr. et al. |
| 6,413,119 | B1 | 7/2002 | Gabrisko, Jr. et al. |
| 6,428,344 | B1 | 8/2002 | Reed |
| 6,431,914 | B1 | 8/2002 | Billman |
| 6,435,913 | B1 | 8/2002 | Billman |
| 6,435,914 | B1 | 8/2002 | Billman |
| 6,441,313 | B1 | 8/2002 | Novak |
| 6,454,605 | B1 | 9/2002 | Bassler et al. |
| 6,461,202 | B2 | 10/2002 | Kline |
| 6,471,549 | B1 | 10/2002 | Lappohn |
| 6,478,624 | B2 | 11/2002 | Ramey et al. |
| 6,482,017 | B1 | 11/2002 | Van Doorn |
| 6,491,545 | B1 | 12/2002 | Spiegel et al. |
| 6,503,103 | B1 | 1/2003 | Cohen et al. |
| 6,506,076 | B2 | 1/2003 | Cohen et al. |
| 6,517,360 | B1 | 2/2003 | Cohen |
| 6,520,803 | B1 | 2/2003 | Dunn |
| 6,527,587 | B1 | 3/2003 | Ortega et al. |
| 6,528,737 | B1 | 3/2003 | Kwong et al. |
| 6,530,790 | B1 | 3/2003 | McNamara et al. |
| 6,533,613 | B1 | 3/2003 | Turner et al. |
| 6,537,087 | B2 | 3/2003 | McNamara et al. |
| 6,538,524 | B1 | 3/2003 | Miller |
| 6,538,899 | B1 | 3/2003 | Krishnamurthi et al. |
| 6,540,522 | B2 | 4/2003 | Sipe |
| 6,540,558 | B1 | 4/2003 | Paagman |
| 6,540,559 | B1 | 4/2003 | Kemmick et al. |
| 6,541,712 | B1 | 4/2003 | Gately et al. |
| 6,544,072 | B2 | 4/2003 | Olson |
| 6,544,647 | B1 | 4/2003 | Hayashi et al. |
| 6,551,140 | B2 | 4/2003 | Billman et al. |
| 6,554,647 | B1 | 4/2003 | Cohen et al. |
| 6,565,387 | B2 | 5/2003 | Cohen |
| 6,565,390 | B2 | 5/2003 | Wu |
| 6,579,116 | B2 | 6/2003 | Brennan et al. |
| 6,582,244 | B2 | 6/2003 | Fogg et al. |
| 6,585,540 | B2 | 7/2003 | Gutierrez et al. |
| 6,592,381 | B2 | 7/2003 | Cohen et al. |
| 6,595,802 | B1 | 7/2003 | Watanabe et al. |
| 6,602,095 | B2 | 8/2003 | Astbury, Jr. et al. |
| 6,607,402 | B2 | 8/2003 | Cohen et al. |
| 6,608,762 | B2 | 8/2003 | Patriche |
| 6,609,933 | B2 | 8/2003 | Yamasaki |
| 6,612,871 | B1 | 9/2003 | Givens |
| 6,616,482 | B2 | 9/2003 | De La Cruz et al. |
| 6,616,864 | B1 | 9/2003 | Jiang et al. |
| 6,621,373 | B1 | 9/2003 | Mullen et al. |
| 6,652,318 | B1 | 11/2003 | Winings et al. |
| 6,652,319 | B1 | 11/2003 | Billman |
| 6,655,966 | B2 | 12/2003 | Rothermel et al. |
| 6,663,427 | B1 | 12/2003 | Billman et al. |
| 6,663,429 | B1 | 12/2003 | Korsunsky et al. |
| 6,692,272 | B2 | 2/2004 | Lemke et al. |
| 6,705,895 | B2 | 3/2004 | Hasircoglu |
| 6,706,974 | B2 | 3/2004 | Chen et al. |
| 6,709,294 | B1 | 3/2004 | Cohen et al. |
| 6,712,648 | B2 | 3/2004 | Padro et al. |
| 6,713,672 | B1 | 3/2004 | Stickney |
| 6,717,825 | B2 | 4/2004 | Volstorf |
| 6,722,897 | B1 | 4/2004 | Wu |
| 6,741,141 | B2 | 5/2004 | Kormanyos |
| 6,743,057 | B2 | 6/2004 | Davis et al. |
| 6,749,444 | B2 | 6/2004 | Murr et al. |
| 6,762,941 | B2 | 7/2004 | Roth |
| 6,764,341 | B2 | 7/2004 | Lappoehn |
| 6,776,645 | B2 | 8/2004 | Roth et al. |
| 6,776,659 | B1 | 8/2004 | Stokoe et al. |
| 6,786,771 | B2 | 9/2004 | Gailus |
| 6,792,941 | B2 | 9/2004 | Andersson |
| 6,806,109 | B2 | 10/2004 | Furuya et al. |
| 6,808,419 | B1 | 10/2004 | Korsunsky et al. |
| 6,808,420 | B2 | 10/2004 | Whiteman, Jr. et al. |
| 6,814,519 | B2 | 11/2004 | Policicchio et al. |
| 6,814,619 | B1 | 11/2004 | Stokoe et al. |
| 6,816,486 | B1 | 11/2004 | Rogers |
| 6,817,870 | B1 | 11/2004 | Kwong et al. |
| 6,823,587 | B2 | 11/2004 | Reed |
| 6,830,478 | B1 | 12/2004 | Ko et al. |
| 6,830,483 | B1 | 12/2004 | Wu |
| 6,830,489 | B2 | 12/2004 | Aoyama |
| 6,857,899 | B2 | 2/2005 | Reed et al. |
| 6,872,085 | B1 | 3/2005 | Cohen et al. |
| 6,875,031 | B1 | 4/2005 | Korsunsky et al. |
| 6,899,566 | B2 | 5/2005 | Kline et al. |
| 6,903,939 | B1 | 6/2005 | Chea, Jr. et al. |
| 6,913,490 | B2 | 7/2005 | Whiteman, Jr. et al. |
| 6,932,649 | B1 | 8/2005 | Rothermel et al. |
| 6,957,967 | B2 | 10/2005 | Petersen et al. |
| 6,960,103 | B2 | 11/2005 | Tokunaga |
| 6,971,916 | B2 | 12/2005 | Tokunaga |
| 6,979,202 | B2 | 12/2005 | Benham et al. |
| 6,979,226 | B2 | 12/2005 | Otsu et al. |
| 6,982,378 | B2 | 1/2006 | Dickson |
| 7,004,793 | B2 | 2/2006 | Scherer et al. |
| 7,021,969 | B2 | 4/2006 | Matsunaga |
| 7,044,794 | B2 | 5/2006 | Consoli et al. |
| 7,057,570 | B2 | 6/2006 | Irion, II et al. |
| 7,074,086 | B2 | 7/2006 | Cohen et al. |
| 7,094,102 | B2 | 8/2006 | Cohen et al. |
| 7,108,556 | B2 | 9/2006 | Cohen et al. |
| 7,120,327 | B2 | 10/2006 | Bozso et al. |
| 7,137,849 | B2 | 11/2006 | Nagata |
| 7,163,421 | B1 | 1/2007 | Cohen et al. |
| 7,182,643 | B2 | 2/2007 | Winings et al. |
| 7,229,318 | B2 | 6/2007 | Winings et al. |
| 7,261,591 | B2 | 8/2007 | Korsunsky et al. |
| 7,270,573 | B2 | 9/2007 | Houtz |
| 7,285,018 | B2 | 10/2007 | Kenny et al. |
| 7,303,427 | B2 | 12/2007 | Swain |
| 7,309,239 | B2 | 12/2007 | Shuey et al. |
| 7,309,257 | B1 | 12/2007 | Minich |
| 7,316,585 | B2 | 1/2008 | Smith et al. |
| 7,322,855 | B2 | 1/2008 | Mongold et al. |
| 7,331,830 | B2 | 2/2008 | Minich |
| 7,335,063 | B2 | 2/2008 | Cohen et al. |
| 7,347,721 | B2 | 3/2008 | Kameyama |
| 7,351,114 | B2 | 4/2008 | Benham et al. |
| 7,354,274 | B2 | 4/2008 | Minich |
| 7,365,269 | B2 | 4/2008 | Donazzi et al. |

(56) References Cited

U.S. PATENT DOCUMENTS 7,371,117 B2 5/2008 Gailus
7,390,218 B2 6/2008 Smith et al.
7,390,220 B1 6/2008 Wu
7,407,413 B2 8/2008 Minich
7,494,383 B2 2/2009 Cohen et al.
7,540,781 B2 6/2009 Kenny et al.
7,554,096 B2 6/2009 Ward et al.
7,581,990 B2 9/2009 Kirk et al.
7,585,186 B2 9/2009 McAlonis et al.
7,588,464 B2 9/2009 Kim
7,588,467 B2 9/2009 Chang
7,594,826 B2 9/2009 Kobayashi et al.
7,604,490 B2 10/2009 Chen et al.
7,604,502 B2 10/2009 Pan
7,674,133 B2 3/2010 Fogg et al.
7,690,946 B2 4/2010 Knaub et al.
7,699,644 B2 4/2010 Szczesny et al.
7,699,663 B1 4/2010 Little et al.
7,722,401 B2 5/2010 Kirk et al.
7,731,537 B2 6/2010 Amleshi et al.
7,753,731 B2 7/2010 Cohen et al.
7,758,357 B2 7/2010 Pan et al.
7,771,233 B2 8/2010 Gailus
7,789,676 B2 9/2010 Morgan et al.
7,794,240 B2 9/2010 Cohen et al.
7,794,278 B2 9/2010 Cohen et al.
7,806,729 B2 10/2010 Nguyen et al.
7,828,595 B2 11/2010 Mathews
7,833,068 B2 * 11/2010 Bright ..... H01R 13/502 439/733.1
7,871,296 B2 1/2011 Fowler et al.
7,874,873 B2 1/2011 Do et al.
7,887,371 B2 2/2011 Kenny et al.
7,887,379 B2 2/2011 Kirk
7,906,730 B2 3/2011 Atkinson et al.
7,914,304 B2 3/2011 Cartier et al.
7,927,143 B2 4/2011 Helster et al.
7,985,097 B2 7/2011 Gulla
8,018,733 B2 9/2011 Jia
8,057,267 B2 11/2011 Johnescu
8,083,553 B2 12/2011 Manter et al.
8,167,631 B2 * 5/2012 Ito ..... H01R 12/737 439/108
8,182,289 B2 5/2012 Stokoe et al.
8,215,968 B2 7/2012 Cartier et al.
8,216,001 B2 7/2012 Kirk
8,251,745 B2 8/2012 Johnescu et al.
8,267,721 B2 9/2012 Minich
8,272,877 B2 9/2012 Stokoe et al.
8,328,565 B2 * 12/2012 Westman ..... H01R 13/6471 439/682
8,348,701 B1 1/2013 Lan et al.
8,371,875 B2 2/2013 Gailus
8,382,524 B2 2/2013 Khilchenko et al.
8,545,240 B2 * 10/2013 Casher ..... H01R 13/6474 439/108
8,550,861 B2 10/2013 Cohen et al.
8,657,627 B2 2/2014 McNamara et al.
8,678,860 B2 3/2014 Minich et al.
8,715,003 B2 5/2014 Buck et al.
8,715,005 B2 5/2014 Pan
8,764,460 B2 * 7/2014 Smink ..... H01R 13/6597 439/92
8,764,488 B2 * 7/2014 Zeng ..... H01R 13/6585 439/108
8,771,016 B2 7/2014 Atkinson et al.
8,864,521 B2 10/2014 Atkinson et al.
8,926,377 B2 1/2015 Kirk et al.
8,944,831 B2 2/2015 Stoner et al.
8,944,863 B1 * 2/2015 Yang ..... H01R 13/6585 439/733.1
8,998,642 B2 4/2015 Manter et al.
9,004,942 B2 4/2015 Paniagua
9,011,177 B2 4/2015 Lloyd et al.
9,022,806 B2 5/2015 Cartier, Jr. et al.
9,028,201 B2 5/2015 Kirk et al.
9,028,281 B2 5/2015 Kirk et al.
9,065,230 B2 6/2015 Milbrand, Jr.
9,077,115 B2 7/2015 Yang
9,083,130 B2 7/2015 Casher et al.
9,124,009 B2 9/2015 Atkinson et al.
9,219,335 B2 12/2015 Atkinson et al.
9,225,083 B2 12/2015 Krenceski et al.
9,225,085 B2 12/2015 Cartier, Jr. et al.
9,257,778 B2 2/2016 Buck et al.
9,257,794 B2 2/2016 Wanha et al.
9,300,074 B2 3/2016 Gailus
9,401,570 B2 * 7/2016 Phillips ..... H01R 13/6583
9,450,344 B2 9/2016 Cartier, Jr. et al.
9,461,378 B1 10/2016 Chen
9,484,674 B2 11/2016 Cartier, Jr. et al.
9,509,101 B2 11/2016 Cartier, Jr. et al.
9,520,689 B2 12/2016 Cartier, Jr. et al.
9,634,432 B2 * 4/2017 Su ..... H01R 13/6582
9,692,183 B2 * 6/2017 Phillips ..... H01R 13/6471
9,692,188 B2 6/2017 Godana et al.
9,705,218 B2 * 7/2017 Ito ..... H01R 13/6471
9,705,255 B2 7/2017 Atkinson et al.
9,742,132 B1 8/2017 Hsueh
9,748,698 B1 8/2017 Morgan et al.
9,831,588 B2 11/2017 Cohen
9,843,135 B2 12/2017 Guetig et al.
9,899,774 B2 2/2018 Gailus
9,923,309 B1 3/2018 Aizawa et al.
9,972,945 B1 5/2018 Huang et al.
9,979,136 B1 * 5/2018 Wu ..... H01R 13/6597
9,985,389 B1 5/2018 Morgan et al.
10,038,284 B2 7/2018 Krenceski et al.
10,096,921 B2 10/2018 Johnescu et al.
10,122,129 B2 11/2018 Milbrand, Jr. et al.
10,148,025 B1 12/2018 Trout et al.
10,186,814 B2 1/2019 Khilchenko et al.
10,211,577 B2 2/2019 Milbrand, Jr. et al.
10,243,304 B2 3/2019 Kirk et al.
10,270,191 B1 4/2019 Li et al.
10,283,910 B1 5/2019 Chen et al.
10,348,040 B2 7/2019 Cartier, Jr. et al.
10,355,416 B1 7/2019 Pickel et al.
10,381,767 B1 8/2019 Milbrand, Jr. et al.
10,431,936 B2 10/2019 Horning et al.
10,446,983 B2 10/2019 Krenceski et al.
10,511,128 B2 12/2019 Kirk et al.
10,601,181 B2 3/2020 Lu et al.
10,777,921 B2 9/2020 Lu et al.
10,797,417 B2 10/2020 Scholeno et al.
10,847,936 B2 * 11/2020 Tang ..... H01R 12/727
10,916,894 B2 2/2021 Kirk et al.
10,931,050 B2 2/2021 Cohen
10,938,162 B2 * 3/2021 Lin ..... H01R 13/6471
10,965,063 B2 3/2021 Krenceski et al.
11,189,971 B2 11/2021 Lu
11,381,039 B2 * 7/2022 Hsiao ..... H01R 13/646
11,600,950 B2 * 3/2023 Takai ..... H05K 1/111
2001/0012730 A1 8/2001 Ramey et al.
2001/0041477 A1 11/2001 Billman et al.
2001/0042632 A1 11/2001 Manov et al.
2001/0046810 A1 11/2001 Cohen et al.
2002/0042223 A1 4/2002 Belopolsky et al.
2002/0086582 A1 7/2002 Nitta et al.
2002/0089464 A1 7/2002 Joshi
2002/0098738 A1 7/2002 Astbury et al.
2002/0102885 A1 8/2002 Kline
2002/0111068 A1 8/2002 Cohen et al.
2002/0111069 A1 8/2002 Astbury et al.
2002/0115335 A1 8/2002 Saito
2002/0123266 A1 9/2002 Ramey et al.
2002/0136506 A1 9/2002 Asada et al.
2002/0146926 A1 10/2002 Fogg et al.
2002/0168898 A1 11/2002 Billman et al.
2002/0172469 A1 11/2002 Benner et al.
2002/0181215 A1 12/2002 Guenthner
2002/0192988 A1 12/2002 Droesbeke et al.
2003/0003803 A1 1/2003 Billman et al.

(56) References Cited

U.S. PATENT DOCUMENTS

2003/0008561 A1 1/2003 Lappoehn
2003/0008562 A1 1/2003 Yamasaki
2003/0022555 A1 1/2003 Vicich et al.
2003/0027439 A1 2/2003 Johnescu et al.
2003/0109174 A1 6/2003 Korsunsky et al.
2003/0143894 A1 7/2003 Kline et al.
2003/0147227 A1 8/2003 Egitto et al.
2003/0162441 A1 8/2003 Nelson et al.
2003/0220018 A1 11/2003 Winings et al.
2003/0220021 A1 11/2003 Whiteman et al.
2004/0001299 A1 1/2004 van Haaster et al.
2004/0005815 A1 1/2004 Mizumura et al.
2004/0020674 A1 2/2004 McFadden et al.
2004/0043661 A1 3/2004 Okada et al.
2004/0072473 A1 4/2004 Wu
2004/0097112 A1 5/2004 Minich et al.
2004/0115968 A1 6/2004 Cohen
2004/0121652 A1 6/2004 Gailus
2004/0171305 A1 9/2004 McGowan et al.
2004/0196112 A1 10/2004 Welbon et al.
2004/0224559 A1 11/2004 Nelson et al.
2004/0235352 A1 11/2004 Takemasa
2004/0259419 A1 12/2004 Payne et al.
2005/0006119 A1 1/2005 Cunningham et al.
2005/0020135 A1 1/2005 Whiteman et al.
2005/0039331 A1 2/2005 Smith
2005/0048838 A1 3/2005 Korsunsky et al.
2005/0048842 A1 3/2005 Benham et al.
2005/0070160 A1 3/2005 Cohen et al.
2005/0090299 A1 4/2005 Tsao et al.
2005/0133245 A1 6/2005 Katsuyama et al.
2005/0148239 A1 7/2005 Hull et al.
2005/0176300 A1 8/2005 Hsu et al.
2005/0176835 A1 8/2005 Kobayashi et al.
2005/0215121 A1 9/2005 Tokunaga
2005/0233610 A1 10/2005 Tutt et al.
2005/0277315 A1 12/2005 Mongold et al.
2005/0283974 A1 12/2005 Richard et al.
2005/0287869 A1 12/2005 Kenny et al.
2006/0009080 A1 1/2006 Regnier et al.
2006/0019517 A1 1/2006 Raistrick et al.
2006/0019538 A1 1/2006 Davis et al.
2006/0024983 A1 2/2006 Cohen et al.
2006/0024984 A1 2/2006 Cohen et al.
2006/0068640 A1 3/2006 Gailus
2006/0073709 A1 4/2006 Reid
2006/0104010 A1 5/2006 Donazzi et al.
2006/0110977 A1 5/2006 Matthews
2006/0141866 A1 6/2006 Shiu
2006/0166551 A1 7/2006 Korsunsky et al.
2006/0216969 A1 9/2006 Bright et al.
2006/0255876 A1 11/2006 Kushta et al.
2006/0292932 A1 12/2006 Benham et al.
2007/0004282 A1 1/2007 Cohen et al.
2007/0004828 A1 1/2007 Khabbaz
2007/0021000 A1 1/2007 Laurx
2007/0021001 A1 1/2007 Laurx et al.
2007/0021002 A1 1/2007 Laurx et al.
2007/0021003 A1 1/2007 Laurx et al.
2007/0021004 A1 1/2007 Laurx et al.
2007/0037419 A1 2/2007 Sparrowhawk
2007/0042639 A1 2/2007 Manter et al.
2007/0054554 A1 3/2007 Do et al.
2007/0059961 A1 3/2007 Cartier et al.
2007/0111597 A1 5/2007 Kondou et al.
2007/0141872 A1 6/2007 Szczesny et al.
2007/0155241 A1 7/2007 Lappohn
2007/0218765 A1 9/2007 Cohen et al.
2007/0275583 A1 11/2007 McNutt et al.
2008/0050968 A1 2/2008 Chang
2008/0194146 A1 8/2008 Gailus
2008/0246555 A1 10/2008 Kirk et al.
2008/0248658 A1 10/2008 Cohen et al.
2008/0248659 A1 10/2008 Cohen et al.
2008/0248660 A1 10/2008 Kirk et al.
2008/0318455 A1 12/2008 Beaman et al.
2009/0011641 A1 1/2009 Cohen et al.
2009/0011643 A1 1/2009 Amleshi et al.
2009/0011645 A1 1/2009 Laurx et al.
2009/0029602 A1 1/2009 Cohen et al.
2009/0035955 A1 2/2009 McNamara
2009/0061661 A1 3/2009 Shuey et al.
2009/0117386 A1 5/2009 Vacanti et al.
2009/0124101 A1 5/2009 Minich et al.
2009/0149045 A1 6/2009 Chen et al.
2009/0203259 A1 8/2009 Nguyen et al.
2009/0239395 A1 9/2009 Cohen et al.
2009/0258516 A1 10/2009 Hiew et al.
2009/0291593 A1 11/2009 Atkinson et al.
2009/0305530 A1 12/2009 Ito et al.
2009/0305533 A1 12/2009 Feldman et al.
2009/0305553 A1 12/2009 Thomas et al.
2010/0048058 A1 2/2010 Morgan et al.
2010/0081302 A1 4/2010 Atkinson et al.
2010/0099299 A1 4/2010 Moriyama et al.
2010/0144167 A1 6/2010 Fedder et al.
2010/0273359 A1 10/2010 Walker et al.
2010/0291806 A1 11/2010 Minich et al.
2010/0294530 A1 11/2010 Atkinson et al.
2011/0003509 A1 1/2011 Gailus
2011/0067237 A1 3/2011 Cohen et al.
2011/0104948 A1 5/2011 Girard, Jr. et al.
2011/0130038 A1 6/2011 Cohen et al.
2011/0212649 A1 9/2011 Stokoe et al.
2011/0212650 A1 9/2011 Amleshi et al.
2011/0230095 A1 9/2011 Atkinson et al.
2011/0230096 A1 9/2011 Atkinson et al.
2011/0256739 A1 10/2011 Toshiyuki et al.
2011/0287663 A1 11/2011 Gailus et al.
2012/0077380 A1 3/2012 Minich et al.
2012/0094536 A1 4/2012 Khilchenko et al.
2012/0115371 A1 5/2012 Chuang et al.
2012/0156929 A1 6/2012 Manter et al.
2012/0184154 A1 7/2012 Frank et al.
2012/0202363 A1 8/2012 McNamara et al.
2012/0202386 A1 8/2012 McNamara et al.
2012/0202387 A1 8/2012 McNamara
2012/0214343 A1 8/2012 Buck et al.
2012/0214344 A1 8/2012 Cohen et al.
2013/0012038 A1 1/2013 Kirk et al.
2013/0017733 A1 1/2013 Kirk et al.
2013/0065454 A1 3/2013 Milbrand Jr.
2013/0078870 A1 3/2013 Milbrand, Jr.
2013/0078871 A1 3/2013 Milbrand, Jr.
2013/0090001 A1 4/2013 Kagotani
2013/0109232 A1 5/2013 Paniaqua
2013/0143442 A1 6/2013 Cohen et al.
2013/0196553 A1 8/2013 Gailus
2013/0217263 A1 8/2013 Pan
2013/0225006 A1 8/2013 Khilchenko et al.
2013/0237092 A1* 9/2013 Rubens ..... H01R 13/6596 439/607.23
2013/0273781 A1 10/2013 Buck et al.
2013/0288513 A1 10/2013 Masubuchi et al.
2013/0316590 A1 11/2013 Hon
2013/0340251 A1 12/2013 Regnier et al.
2014/0004724 A1 1/2014 Cartier, Jr. et al.
2014/0004726 A1 1/2014 Cartier, Jr. et al.
2014/0004746 A1 1/2014 Cartier, Jr. et al.
2014/0057498 A1 2/2014 Cohen
2014/0273557 A1 9/2014 Cartier, Jr. et al.
2014/0273627 A1 9/2014 Cartier, Jr. et al.
2015/0056856 A1 2/2015 Atkinson et al.
2015/0111427 A1 4/2015 Foxconn
2015/0188250 A1* 7/2015 Liu ..... H01R 13/504 439/86
2015/0236451 A1 8/2015 Cartier, Jr. et al.
2015/0236452 A1 8/2015 Cartier, Jr. et al.
2015/0255926 A1 9/2015 Paniagua
2015/0380868 A1 12/2015 Chen et al.
2016/0000616 A1 1/2016 Lavoie
2016/0134057 A1 5/2016 Buck et al.
2016/0149343 A1 5/2016 Atkinson et al.
2016/0156133 A1 6/2016 Masubuchi et al.

(56) References Cited

U.S. PATENT DOCUMENTS

| | | | | |
|---|---|---|---|---|
| 2016/0172794 | A1 | 6/2016 | Sparrowhawk et al. | |
| 2016/0211618 | A1 | 7/2016 | Gailus | |
| 2017/0352970 | A1 | 12/2017 | Liang et al. | |
| 2018/0062323 | A1 | 3/2018 | Kirk et al. | |
| 2018/0109043 | A1 | 4/2018 | Provencher et al. | |
| 2018/0145438 | A1 | 5/2018 | Cohen | |
| 2018/0166828 | A1 | 6/2018 | Gailus | |
| 2018/0198220 | A1 | 7/2018 | Sasame et al. | |
| 2018/0205177 | A1 | 7/2018 | Zhou et al. | |
| 2018/0212376 | A1 | 7/2018 | Wang et al. | |
| 2018/0219331 | A1 | 8/2018 | Cartier, Jr. et al. | |
| 2018/0269607 | A1 | 9/2018 | Wu et al. | |
| 2019/0036256 | A1 | 1/2019 | Martens et al. | |
| 2019/0052019 | A1 | 2/2019 | Huang et al. | |
| 2019/0067854 | A1 | 2/2019 | Ju et al. | |
| 2019/0131743 | A1* | 5/2019 | Hsu | H01R 13/405 |
| 2019/0173209 | A1 | 6/2019 | Lu et al. | |
| 2019/0173232 | A1 | 6/2019 | Lu et al. | |
| 2019/0312389 | A1* | 10/2019 | Little | H01R 13/6594 |
| 2019/0334292 | A1 | 10/2019 | Cartier, Jr. et al. | |
| 2020/0021052 | A1 | 1/2020 | Milbrand, Jr. et al. | |
| 2020/0076132 | A1 | 3/2020 | Yang et al. | |
| 2020/0161811 | A1 | 5/2020 | Lu | |
| 2020/0194940 | A1 | 6/2020 | Cohen et al. | |
| 2020/0220289 | A1 | 7/2020 | Scholeno et al. | |
| 2020/0235529 | A1 | 7/2020 | Kirk et al. | |
| 2020/0251841 | A1 | 8/2020 | Stokoe et al. | |
| 2020/0259294 | A1 | 8/2020 | Lu | |
| 2020/0266584 | A1 | 8/2020 | Lu | |
| 2020/0266585 | A1 | 8/2020 | Paniagua et al. | |
| 2020/0315027 | A1* | 10/2020 | Muronoi | H05K 5/0034 |
| 2020/0395698 | A1 | 12/2020 | Hou et al. | |
| 2020/0403350 | A1 | 12/2020 | Hsu | |
| 2020/0412060 | A1* | 12/2020 | Hsieh | H01R 13/6471 |
| 2021/0036465 | A1* | 2/2021 | Tang | H01R 12/721 |
| 2021/0050683 | A1 | 2/2021 | Sasame et al. | |
| 2021/0159643 | A1 | 5/2021 | Kirk et al. | |
| 2021/0175670 | A1 | 6/2021 | Cartier, Jr. et al. | |
| 2021/0194187 | A1* | 6/2021 | Chen | H01R 4/04 |
| 2021/0203096 | A1 | 7/2021 | Cohen | |
| 2021/0234314 | A1 | 7/2021 | Johnescu et al. | |
| 2021/0234315 | A1 | 7/2021 | Ellison et al. | |
| 2021/0242632 | A1 | 8/2021 | Trout et al. | |
| 2021/0320461 | A1* | 10/2021 | Buck | H01R 12/62 |
| 2022/0094099 | A1 | 3/2022 | Liu et al. | |
| 2022/0399663 | A1* | 12/2022 | Chang | H01R 12/71 |

FOREIGN PATENT DOCUMENTS

| | | | | | |
|---|---|---|---|---|---|
| CN | 1237652 | A | | 12/1999 | |
| CN | 1265470 | A | | 9/2000 | |
| CN | 2400938 | Y | | 10/2000 | |
| CN | 1276597 | A | | 12/2000 | |
| CN | 1280405 | A | | 1/2001 | |
| CN | 1299524 | A | | 6/2001 | |
| CN | 2513247 | Y | | 9/2002 | |
| CN | 2519434 | Y | | 10/2002 | |
| CN | 2519458 | Y | | 10/2002 | |
| CN | 2519592 | Y | | 10/2002 | |
| CN | 1394829 | A | | 2/2003 | |
| CN | 1398446 | A | | 2/2003 | |
| CN | 1401147 | A | | 3/2003 | |
| CN | 1471749 | A | | 1/2004 | |
| CN | 1489810 | A | | 4/2004 | |
| CN | 1491465 | A | | 4/2004 | |
| CN | 1502151 | A | | 6/2004 | |
| CN | 1516723 | A | | 7/2004 | |
| CN | 1179448 | C | | 12/2004 | |
| CN | 1561565 | A | | 1/2005 | |
| CN | 1203341 | C | | 5/2005 | |
| CN | 1639866 | A | | 7/2005 | |
| CN | 1650479 | A | | 8/2005 | |
| CN | 1764020 | A | | 4/2006 | |
| CN | 1799290 | A | | 7/2006 | |
| CN | 2798361 | Y | | 7/2006 | |
| CN | 2865050 | Y | | 1/2007 | |
| CN | 1985199 | A | | 6/2007 | |
| CN | 101032060 | A | | 9/2007 | |
| CN | 201000949 | Y | | 1/2008 | |
| CN | 101124697 | A | | 2/2008 | |
| CN | 101176389 | A | | 5/2008 | |
| CN | 101208837 | A | | 6/2008 | |
| CN | 101273501 | A | | 9/2008 | |
| CN | 201112782 | Y | | 9/2008 | |
| CN | 101312275 | A | | 11/2008 | |
| CN | 101316012 | A | | 12/2008 | |
| CN | 201222548 | Y | | 4/2009 | |
| CN | 201252183 | Y | | 6/2009 | |
| CN | 101552410 | A | | 10/2009 | |
| CN | 101600293 | A | | 12/2009 | |
| CN | 201374433 | Y | | 12/2009 | |
| CN | 101752700 | A | | 6/2010 | |
| CN | 101790818 | A | | 7/2010 | |
| CN | 101120490 | B | | 11/2010 | |
| CN | 101964463 | A | | 2/2011 | |
| CN | 101124697 | B | | 3/2011 | |
| CN | 201846527 | U | | 5/2011 | |
| CN | 102106041 | A | | 6/2011 | |
| CN | 102195173 | A | | 9/2011 | |
| CN | 102232259 | A | | 11/2011 | |
| CN | 102239605 | A | | 11/2011 | |
| CN | 102282731 | A | | 12/2011 | |
| CN | 102292881 | A | | 12/2011 | |
| CN | 101600293 | B | | 5/2012 | |
| CN | 102570100 | A | | 7/2012 | |
| CN | 102598430 | A | | 7/2012 | |
| CN | 101258649 | B | | 9/2012 | |
| CN | 102738621 | A | | 10/2012 | |
| CN | 102176586 | B | | 11/2012 | |
| CN | 102859805 | A | | 1/2013 | |
| CN | 202695788 | U | | 1/2013 | |
| CN | 202695861 | U | | 1/2013 | |
| CN | 102986091 | A | | 3/2013 | |
| CN | 103036081 | A | | 4/2013 | |
| CN | 103594871 | A | | 2/2014 | |
| CN | 204190038 | U | | 3/2015 | |
| CN | 104577577 | A | | 4/2015 | |
| CN | 205212085 | U | | 5/2016 | |
| CN | 102820589 | B | | 8/2016 | |
| CN | 106099546 | A | | 11/2016 | |
| CN | 107069274 | A | | 8/2017 | |
| CN | 304240766 | S | | 8/2017 | |
| CN | 304245430 | S | | 8/2017 | |
| CN | 206712089 | U | | 12/2017 | |
| CN | 207677189 | U | | 7/2018 | |
| CN | 108832338 | A | * | 11/2018 | H01R 12/716 |
| CN | 109994892 | A | | 7/2019 | |
| CN | 111555069 | A | | 8/2020 | |
| CN | 112134095 | A | * | 12/2020 | H01R 12/72 |
| CN | 213636403 | U | | 7/2021 | |
| DE | 4109863 | A1 | | 10/1992 | |
| DE | 4238777 | A1 | | 5/1993 | |
| DE | 19853837 | C1 | | 2/2000 | |
| DE | 102006044479 | A1 | | 5/2007 | |
| DE | 60216728 | T2 | | 11/2007 | |
| EP | 0560551 | A1 | | 9/1993 | |
| EP | 0 774 807 | A2 | | 5/1997 | |
| EP | 0 903 816 | A2 | | 3/1999 | |
| EP | 1018784 | A1 | | 7/2000 | |
| EP | 1 779 472 | A1 | | 5/2007 | |
| EP | 1794845 | A1 | | 6/2007 | |
| EP | 2 169 770 | A2 | | 3/2010 | |
| EP | 2262061 | A1 | | 12/2010 | |
| EP | 2388867 | A2 | | 11/2011 | |
| EP | 2405537 | A1 | | 1/2012 | |
| EP | 1794845 | B1 | | 3/2013 | |
| GB | 1272347 | A | | 4/1972 | |
| GB | 2161658 | A | | 1/1986 | |
| GB | 2283620 | A | | 5/1995 | |
| HK | 1043254 | A1 | | 9/2002 | |
| JP | H05-54201 | A | | 3/1993 | |
| JP | H05-234642 | A | | 9/1993 | |
| JP | H07-57813 | A | | 3/1995 | |
| JP | H07-302649 | A | | 11/1995 | |

(56) References Cited

FOREIGN PATENT DOCUMENTS

| | | | |
|---|---|---|---|
| JP | H09-63703 | A | 3/1997 |
| JP | H09-274969 | A | 10/1997 |
| JP | 2711601 | B2 | 2/1998 |
| JP | H11-67367 | A | 3/1999 |
| JP | 2896836 | B2 | 5/1999 |
| JP | H11-233200 | A | 8/1999 |
| JP | H11-260497 | A | 9/1999 |
| JP | 2000-013081 | A | 1/2000 |
| JP | 2000-311749 | A | 11/2000 |
| JP | 2001-068888 | A | 3/2001 |
| JP | 2001-510627 | A | 7/2001 |
| JP | 2001-217052 | A | 8/2001 |
| JP | 2002-042977 | A | 2/2002 |
| JP | 2002-053757 | A | 2/2002 |
| JP | 2002-075052 | A | 3/2002 |
| JP | 2002-075544 | A | 3/2002 |
| JP | 2002-117938 | A | 4/2002 |
| JP | 2002-246107 | A | 8/2002 |
| JP | 2003-017193 | A | 1/2003 |
| JP | 2003-309395 | A | 10/2003 |
| JP | 2004-192939 | A | 7/2004 |
| JP | 2004-259621 | A | 9/2004 |
| JP | 3679470 | B2 | 8/2005 |
| JP | 2006-344524 | A | 12/2006 |
| JP | 2008-515167 | A | 5/2008 |
| JP | 2009-043717 | A | 2/2009 |
| JP | 2009-110956 | A | 5/2009 |
| MX | 9907324 | A1 | 8/2000 |
| TW | 466650 | B | 12/2001 |
| TW | 517002 | B | 1/2003 |
| TW | 534494 | U | 5/2003 |
| TW | 200501874 | A | 1/2005 |
| TW | 200515773 | A | 5/2005 |
| TW | M274675 | U | 9/2005 |
| TW | M329891 | U | 4/2008 |
| TW | M357771 | U | 5/2009 |
| TW | 200926536 | A | 6/2009 |
| TW | M403141 | U | 5/2011 |
| TW | M494411 | U | 1/2015 |
| TW | I475770 | B | 3/2015 |
| TW | M518837 | U | 3/2016 |
| TW | M558481 | U | 4/2018 |
| TW | M558482 | U | 4/2018 |
| TW | M558483 | U | 4/2018 |
| TW | M559006 | U | 4/2018 |
| TW | M559007 | U | 4/2018 |
| TW | M560138 | U | 5/2018 |
| TW | M562507 | U | 6/2018 |
| TW | M565894 | Y | 8/2018 |
| TW | M565895 | Y | 8/2018 |
| TW | M565899 | Y | 8/2018 |
| TW | M565900 | Y | 8/2018 |
| TW | M565901 | Y | 8/2018 |
| TW | M623128 | U * | 11/2022 |
| WO | WO 85/02265 | A1 | 5/1985 |
| WO | WO 88/05218 | A1 | 7/1988 |
| WO | WO 98/35409 | A1 | 8/1998 |
| WO | WO 01/39332 | A1 | 5/2001 |
| WO | WO 01/57963 | A2 | 8/2001 |
| WO | WO 2002/061892 | A1 | 8/2002 |
| WO | WO 03/013199 | A2 | 2/2003 |
| WO | WO 03/047049 | A1 | 6/2003 |
| WO | WO 2004/034539 | A1 | 4/2004 |
| WO | WO 2004/051809 | A2 | 6/2004 |
| WO | WO 2004/059794 | A2 | 7/2004 |
| WO | WO 2004/059801 | A1 | 7/2004 |
| WO | WO 2004/114465 | A2 | 12/2004 |
| WO | WO 2005/011062 | A2 | 2/2005 |
| WO | WO 2005/114274 | A1 | 12/2005 |
| WO | WO 2006/039277 | A1 | 4/2006 |
| WO | WO 2007/005597 | A2 | 1/2007 |
| WO | WO 2007/005598 | A2 | 1/2007 |
| WO | WO 2007/005599 | A1 | 1/2007 |
| WO | WO 2008/124052 | A2 | 10/2008 |
| WO | WO 2008/124054 | A2 | 10/2008 |
| WO | WO 2008/124057 | A2 | 10/2008 |
| WO | WO 2008/124101 | A2 | 10/2008 |
| WO | WO 2009/111283 | A2 | 9/2009 |
| WO | WO 2010/030622 | A1 | 3/2010 |
| WO | WO 2010/039188 | A1 | 4/2010 |
| WO | WO 2011/060236 | A1 | 5/2011 |
| WO | WO 2011/100740 | A2 | 8/2011 |
| WO | WO 2011/106572 | A2 | 9/2011 |
| WO | WO 2011/139946 | A1 | 11/2011 |
| WO | WO 2011/140438 | A2 | 11/2011 |
| WO | WO 2011/140438 | A3 | 12/2011 |
| WO | WO 2012/160554 | A2 | 8/2012 |
| WO | WO 2013/059317 | A1 | 4/2013 |
| WO | WO 2015/112717 | A1 | 7/2015 |
| WO | WO 2016/008473 | A1 | 1/2016 |
| WO | WO 2018/039164 | A1 | 3/2018 |

OTHER PUBLICATIONS

Chinese Invalidation Request dated Jun. 1, 2021 in connection with Chinese Application No. 200680023997.6.

Chinese Invalidation Request dated Sep. 9, 2021 in connection with Chinese Application No. 201110008089.2.

Chinese Invalidation Request dated Jun. 15, 2021 in connection with Chinese Application No. 201180033750.3.

Chinese Supplemental Observations dated Jun. 17, 2021 in connection with Chinese Application No. 201210249710.9.

Chinese communication for Chinese Application No. 201580014851.4, dated Jun. 1, 2020.

Chinese Office Action for Chinese Application No. 201580014851.4 dated Sep. 4, 2019.

Chinese Invalidation Request dated Mar. 17, 2021 in connection with Chinese Application No. 201610952606.4.

Chinese Office Action for Chinese Application No. 201780064531.9 dated Jan. 2, 2020.

Chinese Office Action for Chinese Application No. 202010467444.1 dated Apr. 2, 2021.

Chinese Office Action for Chinese Application No. 202010825662.8 dated Sep. 3, 2021.

Chinese Office Action for Chinese Application No. 202010922401.8 dated Aug. 6, 2021.

Extended European Search Report for European Application No. EP 11166820.8 dated Jan. 24, 2012.

International Search Report and Written Opinion dated Dec. 28, 2021 in connection with International Application No. PCT/CN2021/119849.

International Preliminary Report on Patentability for International Application No. PCT/US2005/034605 dated Apr. 3, 2007.

International Search Report and Written Opinion for International Application No. PCT/US2005/034605 dated Jan. 26, 2006.

International Preliminary Report on Patentability for International Application No. PCT/US2006/025562 dated Jan. 9, 2008.

International Search Report with Written Opinion for International Application No. PCT/US2006/025562 dated Oct. 31, 2007.

International Preliminary Report on Patentability for International Application No. PCT/US2010/056482 dated May 24, 2012.

International Search Report and Written Opinion for International Application No. PCT/US2010/056482 dated Mar. 14, 2011.

International Preliminary Report on Patentability for International Application No. PCT/US2011/026139 dated Sep. 7, 2012.

International Search Report and Written Opinion for International Application No. PCT/US2011/026139 dated Nov. 22, 2011.

International Search Report and Written Opinion for International Application No. PCT/US2011/034747 dated Jul. 28, 2011.

International Preliminary Report on Patentability for International Application No. PCT/US2012/023689 dated Aug. 15, 2013.

International Search Report and Written Opinion for International Application No. PCT/US2012/023689 dated Sep. 12, 2012.

International Preliminary Report on Patentability for International Application No. PCT/US2012/060610 dated May 1, 2014.

International Search Report and Written Opinion for International Application No. PCT/US2012/060610 dated Mar. 29, 2013.

(56) References Cited

OTHER PUBLICATIONS

International Preliminary Report on Patentability for International Application No. PCT/US2015/012463 dated Aug. 4, 2016.
International Search Report and Written Opinion for International Application No. PCT/US2015/012463 dated May 13, 2015.
International Preliminary Report on Patentability for International Application No. PCT/US2017/047905, dated Mar. 7, 2019.
International Search Report and Written Opinion for International Application No. PCT/US2017/047905 dated Dec. 4, 2017.
International Preliminary Report on Patentability Chapter II dated Apr. 5, 2022 in connection with International Application No. PCT/US2021/015048.
International Search Report and Written Opinion dated Jul. 1, 2021 in connection with International Application No. PCT/US2021/015048.
International Preliminary Report on Patentability Chapter II dated Apr. 1, 2022 in connection with International Application No. PCT/US2021/015073.
International Search Report and Written Opinion dated May 17, 2021 in connection with International Application No. PCT/US2021/015073.
Taiwanese Office Action dated Mar. 5, 2021 in connection with Taiwanese Application No. 106128439.
Taiwanese Office Action dated Mar. 15, 2022 in connection with Taiwanese Application No. 110140608.
Decision Invalidating CN Patent Application No. 201610952606.4, which issued as CN Utility Model Patent No. 107069274B, and Certified Translation.
In re Certain Electrical Connectors and Cages, Components Thereof, and Prods. Containing the Same, Inv. No. 337-TA-1241, Order No. 31 (Oct. 19, 2021): Construing Certain Terms of the Asserted Claims of the Patents at Issue.
In re Matter of Certain Electrical Connectors and Cages, Components Thereof, and Products Containing the Same, Inv. No. 337-TA-1241, Complainant Amphenol Corporation's Corrected Initial Post-Hearing Brief. Public Version. Jan. 5, 2022. 451 pages.
In re Matter of Certain Electrical Connectors and Cages, Components Thereof, and Products Containing the Same, Inv. No. 337-TA-1241, Complainant Amphenol Corporation's Post-Hearing Reply Brief. Public Version. Dec. 6, 2021. 159 pages.
In re Matter of Certain Electrical Connectors and Cages, Components Thereof, and Products Containing the Same, Inv. No. 337-TA-1241, Luxshare Respondents' Initial Post-Hearing Brief. Public Version. Nov. 23, 2021. 348 pages.
In re Matter of Certain Electrical Connectors and Cages, Components Thereof, and Products Containing the Same, Inv. No. 337-TA-1241, Luxshare Respondents' Reply Post-Hearing Brief. Public Version. Dec. 6, 2021. 165 pages.
In re Matter of Certain Electrical Connectors and Cages, Components Thereof, and Products Containing the Same, Inv. No. 337-TA-1241, Notice of Prior Art. Jun. 3, 2021. 319 pages.
In re Matter of Certain Electrical Connectors and Cages, Components Thereof, and Products Containing the Same, Inv. No. 337-TA-1241, Respondents' Pre-Hearing Brief. Redacted. Oct. 21, 2021. 219 pages.
Invalidity Claim Charts Based on CN 201112782Y ("Cai"). Luxshare Respondents' Supplemental Responses to Interrogatories Nos. 13 and 14, Exhibit 25. May 7, 2021. 147 pages.
Invalidity Claim Charts Based on U.S. Pat. No. 6,179,651 ("Huang"). Luxshare Respondents' Supplemental Responses to Interrogatories Nos. 13 and 14, Exhibit 26. May 7, 2021. 153 pages.
Invalidity Claim Charts Based on U.S. Pat. No. 7,261,591 ("Korsunsky"). Luxshare Respondents' Supplemental Responses to Interrogatories Nos. 13 and 14, Exhibit 27. May 7, 2021. 150 pages.
Petition for Inter Partes Review. *Luxshare Precision Industry Co., Ltd* v. *Amphenol Corp*. U.S. Pat. No. 10,381,767. IPR2022-00132. Nov. 4, 2021. 112 pages.
[No Author Listed], SFF-8672 Specification for QSFP+ 4x 28 GB/s Connector (Style B). Revision 1.2. SNIA. Jun. 8, 2018. 21 pages.
[No Author Listed], All About ESD Plastics. Evaluation Engineering. Jul. 1, 1998. 8 pages. https://www.evaluationengineering.com/home/article/13001136/all-about-esdplastics [last accessed Mar. 14, 2021].
[No Author Listed], Amp Incorporated Schematic, Cable Assay, 2 Pair, HMZD. Oct. 3, 2002. 1 page.
[No Author Listed], Board to Backplane Electrical Connector. The Engineer. Mar. 13, 2001, [last accessed Apr. 30, 2021]. 2 pages.
[No Author Listed], Borosil Vision Mezzo Mug Set of 2. Zola. 3 pages. https://www.zola.com/shop/product/borosil_vision_mezzao_mug_setof2_3.25. [date retrieved May 4, 2021].
[No Author Listed], Cable Systems. Samtec. Aug. 2010. 148 pages.
[No Author Listed], Carbon Nanotubes For Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.
[No Author Listed], Coating Electrical Contacts. Brush Wellman Engineered Materials. Jan. 2002;4(1). 2 pages.
[No Author Listed], Common Management Interface Specification. Rev 4.0. MSA Group. May 8, 2019. 265 pages.
[No Author Listed], Electronics Connector Overview. FCI. Sep. 23, 2009. 78 pages.
[No Author Listed], EMIi Shielding Compounds Instead of Metal. RTP Company. Last Accessed Apr. 30, 2021. 2 pages.
[No Author Listed], EMI Shielding Solutions and EMC Testing Services from Laird Technologies. Laird Technologies. Last acessed Apr. 30, 2021. 1 page.
[No Author Listed], EMI Shielding, Dramatic Cost Reductions for Electronic Device Protection. RTP. Jan. 2000. 10 pages.
[No Author Listed], Excerpt from The Concise Oxford Dictionary, Tenth Edition. 1999. 3 pages.
[No Author Listed], Excerpt from The Merriam-Webster Dictionary, Between. 2005. 4 pages.
[No Author Listed], Excerpt from Webster's Third New International Dictionary, Contact. 1986. 3 pages.
[No Author Listed], FCI—High Speed Interconnect Solutions, Backpanel Connectors. FCI. [last accessed Apr. 30, 2021). 2 pages.
[No Author Listed], General Product Specification for GbX Backplane and Daughtercard Interconnect System. Revision "B". Teradyne. Aug. 23, 2005. 12 pages.
[No Author Listed], High Speed Backplane Connectors. Tyco Electronics. Product Catalog No. 1773095. Revised Dec. 2008. 1-40 pages.
[No Author Listed], HOZOX EMI Absorption Sheet and Tape. Molex. Laird Technologies. 2013. 2 pages.
[No Author Listed], INF-8074i Specification for SFP (Small Formfactor Pluggable) Transceiver. SFF Committee. Revision 1.0. May 12, 2001. 39 pages.
[No Author Listed], INF-8438i Specification for QSFP (Quad Small Formfactor Pluggable) Transceiver. Rev 1.0 Nov. 2006. SFF Committee. 76 pages.
[No Author Listed], Interconnect Signal Integrity Handbook. Samtec. Aug. 2007. 21 pages.
[No Author Listed], Metallized Conductive Products: Fabric-Over-Foam, Conductive Foam, Fabric, Tape. Laird Technologies. 2003. 32 pages.
[No Author Listed], Metral® 2000 Series. FCI. 2001. 2 pages.
[No Author Listed], Metral® 2mm High-Speed Connectors 1000, 2000, 3000 Series. FCI. 2000. 119 pages.
[No Author Listed], Metral® 3000 Series. FCI. 2001. 2 pages.
[No Author Listed], Metral® 4000 Series. FCI. 2002. 2 pages.
[No Author Listed], Metral® 4000 Series: High-Speed Backplane Connectors. FCI, Rev. 3. Nov. 30, 2001. 21 pages.
[No Author Listed], Military Fibre Channel High Speed Cable Assembly. www.gore.com. 2008. [last accessed Aug. 2, 2012 via Internet Archive: Wayback Machine http://web.archive.org] Link archived: http://www.gore.com/en.sub.--xx/products/cables/copper/networking/militar-y/military.sub.-- fibre . . . Last archive date Apr. 6, 2008.

(56) References Cited

OTHER PUBLICATIONS

[No Author Listed], Molex Connectors as InfiniBand Solutions. Design World. Nov. 19, 2008. 7 pages. https://www.designworldonline.com/molex-connectors-as-infiniband-solutions/. [last accessed May 3, 2021].
[No Author Listed], OSFP MSA Specification for OSFP Octal Small Form Factor Pluggable Module. Revision 1.11. OSFP MSA. Jun. 26, 2017. 53 pages.
[No Author Listed], OSFP MSA Specification for OSFP Octal Small Form Factor Pluggable Module. Revision 1.12. OSFP MSA. Aug. 1, 2017. 53 pages.
[No Author Listed], OSFP MSA Specification for OSFP Octal Small Form Factor Pluggable Module. Revision 2.0 OSFP MSA. Jan. 14, 2019. 80 pages.
[No Author Listed], OSFP MSA Specification for OSFP Octal Small Form Factor Pluggable Module. Revision 3.0 OSFP MSA. Mar. 14, 2020. 99 pages.
[No Author Listed], Photograph of Molex Connector. Oct. 2021. 1 page.
[No Author Listed], Photograph of TE Connector. Oct. 2021. 1 page.
[No Author Listed], Pluggable Form Products. Tyco Electronics. Mar. 5, 2006. 1 page.
[No Author Listed], Pluggable Input/Output Solutions. Tyco Electronics Catalog 1773408-1. Revised Feb. 2009. 40 pages.
[No Author Listed], QSFP Market Evolves, First Products Emerge. Lightwave. Jan. 22, 2008. pp. 1-8. https://www.lightwaveonline.com/home/article/16662662.
[No Author Listed], QSFP-DD Hardware Specification for QSFP Double Density 8X Pluggable Transceiver, Rev 3.0. QSFP-DD MSA. Sep. 19, 2017. 69 pages.
[No Author Listed], QSFP-DD Hardware Specification for QSFP Double Density 8X Pluggable Transceiver, Rev 4.0. QSFP-DD MSA. Sep. 18, 2018. 68 pages.
[No Author Listed], QSFP-DD MSA QSFP-DA Hardware Specification for QSFP Double Density 8X Pluggable Transceiver. Revision 5.0. QSFP-DD-MSA. Jul. 9, 2019. 82 pages.
[No Author Listed], QSFP-DD MSA QSFP-DD Hardware Specification for QSFP Double Density 8X Pluggable Transceiver. Revision 5.1. QSFP-DD MSA. Aug. 7, 2020. 84 pages.
[No. Author Listed], Qsfp-Dd Msa Qsfp-Dd Specification for QSFP Double Density 8X Pluggable Transceiver. Revision 1.0. QSFP-DD-MSA. Sep. 15, 2016. 69 pages.
[No Author Listed], QSFP-DD Specification for QSFP Double Density 8X Pluggable Transceiver Specification, Rev. 2.0. QSFP-DD MSA. Mar. 13, 2017. 106 pages.
[No Author Listed], RTP Company Introduces "Smart" Plastics for Bluetooth Standard. Press Release. RTP. Jun. 4, 2001. 2 pages.
[No Author Listed], RTP Company Specialty Compounds. RTP. Mar. 2002. 2 pages.
[No Author Listed], RTP Company-EMI/RFI Shielding Compounds (Conductive) Data Sheets. RTP Company. Last accessed Apr. 30, 2021. 4 pages.
[No Author Listed], Samtec Board Interface Guide. Oct. 2002. 253 pages.
[No Author Listed], SFF Committee SFF-8079 Specification for SFP Rate and Application Selection. Revision 1.7. SFF Committee. Feb. 2, 2005. 21 pages.
[No Author Listed], SFF Committee SFF-8089 Specification for SFP (Small Formfactor Pluggable) Rate and Application Codes. Revision 1.3. SFF Committee. Feb. 3, 2005. 18 pages.
[No Author Listed], SFF Committee SFF-8436 Specification for QSFP+ 4X 10 GB/s Pluggable Transceiver. Revision 4.9. SFF Committee. Aug. 31, 2018. 88 pages.
[No Author Listed], SFF Committee SFF-8665 Specification for QSFP+ 28 GB/s 4X Pluggable Transceiver Solution (QSFP28). Revision 1.9. SFF Committee. Jun. 29, 2015. 14 pages.
[No Author Listed], SFF-8075 Specification for PCI Card Version of SFP Cage. Rev 1.0. SFF Committee. Jul. 3, 2001. 11 pages.
[No Author Listed], SFF-8431 Specifications for Enhanced Small Form Factor Pluggable Module SFP+. Revision 4.1. SFF Committee. Jul. 6, 2009. 132 pages.
[No Author Listed], SFF-8432 Specification for SFP+ Module and Cage. Rev 5.1. SFF Committee. Aug. 8, 2012. 18 pages.
[No Author Listed], SFF-8433 Specification for SFP+ Ganged Cage Footprints and Bezel Openings. Rev 0.7. SFF Committee. Jun. 5, 2009. 15 pages.
[No Author Listed], SFF-8477 Specification for Tunable XFP for ITU Frequency Grid Applications. Rev 1.4. SFF Committee. Dec. 4, 2009. 13 pages.
[No Author Listed], SFF-8679 Specification for QSFP+4X Base Electrical Specification. Rev 1.7. SFF Committee. Aug. 12, 2014. 31 pages.
[No Author Listed], SFF-8682 Specification for QSFP+ 4X Connector. Rev 1.1. SNIA SFF TWG Technology Affiliate. Jun. 8, 2018. 19 pages.
[No Author Listed], Shielding Theory and Design. Laird Technologies. Last accessed Apr. 30, 2021. 1 page.
[No Author Listed], Shielding Theory and Design. Laird Technologies. Last accessed Apr. 30, 2021. 2 pages. URL:web.archive.org/web/20030226182710/http://www.lairdtech.com/catalog/staticdata/shieldingtheorydesign/std_3.htm.
[No Author Listed], Shielding Theory and Design. Laird Technologies. Last accessed Apr. 30, 2021. 2 pages. URL:web.archive.org/web/20021223144443/http://www.lairdtech.com/catalog/staticdata/shieldingtheorydesign/std_2.htm.
[No Author Listed], Signal Integrity—Multi-Gigabit Transmission Over Backplane Systems. International Engineering Consortium. 2003;1-8.
[No Author Listed], Signal Integrity Considerations for 10Gbps Transmission over Backplane Systems. DesignCon2001. Teradyne Connections Systems, Inc. 2001. 47 pages.
[No Author Listed], Specification for OSFP Octal Small Form Factor Pluggable Module. Rev 1.0. OSFP MSA. Mar. 17, 2017. 53 pages.
[No Author Listed], TB-2092 GbX Backplane Signal and Power Connector Press-Fit Installation Process. Teradyne. Aug. 8, 2002;1-9.
[No Author Listed], Teradyne Beefs Up High-Speed GbX Connector Platform. EE Times. 2Sep. 20, 2005. 3 pages.
[No Author Listed], Teradyne Connection Systems Introduces the GbX L-Series Connector. Press Release. Teradyne. Mar. 22, 2004. 5 pages.
[No Author Listed], Teradyne Schematic, Daughtercard Connector Assembly 5 Pair GbX, Drawing No. C-163-5101-500. Nov. 6, 2002. 1 page.
[No Author Listed], Tin as a Coating Material. Brush Wellman Engineered Materials. Jan. 2002;4(2). 2 pages.
[No Author Listed], Two and Four Pair HM-Zd Connectors. Tyco Electronics. Oct. 14, 2003;1-8.
[No Author Listed], Tyco Electronics Schematic, Header Assembly, Right Angle, 4 Pair HMZd, Drawing No. C-1469048. Jan. 10, 2002. 1 page.
[No Author Listed], Tyco Electronics Schematic, Receptacle Assembly, 2 Pair 25mm HMZd, Drawing No. C-1469028. Apr. 24, 2002. 1 page.
[No Author Listed], Tyco Electronics Schematic, Receptacle Assembly, 3 Pair 25mm HMZd, Drawing No. C1469081. May 13, 2002. 1 page.
[No Author Listed], Tyco Electronics Schematic, Receptacle Assembly, 4 Pair HMZd, Drawing No. C1469001. Apr. 23, 2002. 1 page.
[No Author Listed], Tyco Electronics Z-Dok+ Connector. May 23, 2003. pp. 1-15. http://zdok.tycoelectronics.com.
[No Author Listed], Tyco Electronics, SFP System. Small Form-Factor Pluggable (SFP) System. Feb. 2001. 1 page.
[No Author Listed], Typical conductive additives—Conductive Compounds. RTP Company. https://www.rtpcompany.com/products/conductive/additives.htm. Last accessed Apr. 30, 2021. 2 pages.
[No Author Listed], Z-Pack HM-Zd Connector, High Speed Backplane Connectors. Tyco Electronics. Catalog 1773095. 2009;5-44.
[No Author Listed], Z-Pack HM-Zd: Connector Noise Analysis for XAUI Applications. Tyco Electronics. Jul. 9, 2001. 19 pages.

(56) References Cited

OTHER PUBLICATIONS

Atkinson et al., High Frequency Electrical Connector, U.S. Appl. No. 15/645,931, filed Jul. 10, 2017.
Beaman, High Performance Mainframe Computer Cables. 1997 Electronic Components and Technology Conference. 1997;911-7.
Chung, Electrical applications of carbon materials. J. of Materials Science. 2004;39:2645-61.
Dahman, Recent Innovations of Inherently Conducting Polymers for Optimal (106-109 Ohm/Sq) ESD Protection Materials. RTD Company. 2001. 8 pages.
Do et al., A Novel Concept Utilizing Conductive Polymers on Power Connectors During Hot Swapping in Live Modular Electronic Systems. IEEE Xplore 2005; downloaded Feb. 18, 2021;340-345.
Eckardt, Co-Injection Charting New Territory and Opening New Markets. Battenfeld GmbH. Journal of Cellular Plastics. 1987;23:555-92.
Elco, Metral® High Bandwidth—A Differential Pair Connector for Applications up to 6 GHz. FCI. Apr. 26, 1999;1-5.
Feller et al., Conductive polymer composites: comparative study of poly(ester)-short carbon fibres and poly(epoxy)-short carbon fibres mechanical and electrical properties. Materials Letters. Feb. 21, 2002;57:64-71.
Getz et al., Understanding and Eliminating EMI in Microcontroller Applications. National Semiconductor Corporation. Aug. 1996. 30 pages.
Grimes et al., A Brief Discussion of EMI Shielding Materials. IEEE. 1993:217-26.
Housden et al., Moulded Interconnect Devices. Prime Faraday Technology Watch. Feb. 2002. 34 pages.
McAlexander, CV of Joseph C. McAlexander III . Exhibit 1009. 2021. 31 pages.
McAlexander, Declaration of Joseph C. McAlexander III in Support of Petition for Inter Partes Review of U.S. Pat. No. 10,381,767. Exhibit 1002. Nov. 4, 2021. 85 pages.
Nadolny et al., Optimizing Connector Selection for Gigabit Signal Speeds. Sep. 2000. 5 pages.
Neelakanta, Handbook of Electromagnetic Materials: Monolithic and Composite Versions and Their Applications. CRC. 1995. 246 pages.
Okinaka, Significance of Inclusions in Electroplated Gold Films for Electronics Applications. Gold Bulletin. Aug. 2000;33(4):117-127.
Ott, Noise Reduction Techniques In Electronic Systems. Wiley. Second Edition. 1988. 124 pages.
Patel et al., Designing 3.125 Gbps Backplane System. Teradyne. 2002. 58 pages.
Preusse, Insert Molding vs. Post Molding Assembly Operations. Society of Manufacturing Engineers. 1998. 8 pages.
Reich et al., Microwave Theory and Techniques. Boston Technical Publishers, Inc. 1965;182-91.
Ross, Focus on Interconnect: Backplanes Get Reference Designs. EE Times. Oct. 27, 2003 [last accessed Apr. 30, 2021]. 4 pages.
Ross, GbX Backplane Demonstrator Helps System Designers Test High-Speed Backplanes. EE Times. Jan. 27, 2004 [last accessed May 5, 2021]. 3 pages.
Shi et al. Improving Signal Integrity in Circuit Boards by Incorporating Absorbing Materials. 2001 Proceedings. 51st Electronic Components and Technology Conference, Orlando FL. 2001:1451-56.
Silva et al., Conducting Materials Based on Epoxy/Graphene Nanoplatelet Composites With Microwave Absorbing Properties: Effect of the Processing Conditions and Ionic Liquid. Frontiers in Materials. Jul. 2019;6(156):1-9. doi: 10.3389/fmats.2019.00156.
Tracy, Rev. 3.0 Specification IP (Intellectual Property). Mar. 20, 2020. 8 pages.
Violette et al., Electromagnetic Compatibility Handbook. Van Nostrand Reinhold Company Inc. 1987. 229 pages.
Wagner et al., Recommended Engineering Practice to Enhance the EMI/EMP Immunity of Electric Power Systems. Electric Research and Management, Inc. Dec. 1992. 209 pages.
Weishalla, Smart Plastic for Bluetooth. RTP Imagineering Plastics. Apr. 2001. 7 pages.
White, A Handbook on Electromagnetic Shielding Materials and Performance. Don Whie Consultants. 1998. Second Edition. 77 pages.
White, EMI Control Methodology and Procedures. Don White Consultants, Inc. Third Edition 1982. 22 pages.
Williams et al., Measurement of Transmission and Reflection of Conductive Lossy Polymers at Millimeter-Wave Frequencies. IEEE Transactions on Electromagnetic Compatibility. Aug. 1990;32(3):236-240.
U.S. Appl. No. 16/518,362, filed Jan. 16, 2020, Milbrand, Jr. et al.
U.S. Appl. No. 16/795,398, filed Feb. 19, 2020, Paniagua et al.
U.S. Appl. No. 17/102,133, filed Nov. 23, 2020, Cartier et al.
U.S. Appl. No. 17/158,214, filed Jan. 26, 2021, Johnescu et al.
U.S. Appl. No. 17/158,543, filed Jan. 26, 2021, Ellison et al.
U.S. Appl. No. 17/164,400, filed Feb. 1, 2021, Kirk et al.
U.S. Appl. No. 17/181,639, filed Feb. 22, 2021, Cohen.
U.S. Appl. No. 17/477,391, filed Sep. 16, 2021, Liu et al.
CN 200580040906.5, Aug. 17, 2021, Chinese Invalidation Request.
CN 200680023997.6, Jun. 1, 2021, Chinese Invalidation Request.
CN 201110008089.2, Sep. 9, 2021, Chinese Invalidation Request.
CN 201180033750.3, Jun. 15, 2021, Chinese Invalidation Request.
CN 201210249710.9, Jun. 17, 2021, Chinese Supplemental Observations.
CN 201580014851.4, Jun. 1, 2020, Chinese communication.
CN 201580014851.4, Sep. 4, 2019, Chinese Office Action.
CN 201610952606.4, Mar. 17, 2021, Chinese Invalidation Request.
CN 201780064531.9, Jan. 2, 2020, Chinese Office Action.
CN 202010467444.1, Apr. 2, 2021, Chinese Office Action.
CN 202010825662.8, Sep. 3, 2021, Chinese Office Action.
CN 202010922401.8, Aug. 6, 2021, Chinese Office Action.
EP 11166820.8, Jan. 24, 2012, Extended European Search Report.
PCT/CN2021/119849, Dec. 28, 2021, International Search Report and Written Opinion.
PCT/US2005/034605, Apr. 3, 2007, International Preliminary Report on Patentability.
PCT/US2005/034605, Jan. 26, 2006, International Search Report and Written Opinion.
PCT/US2006/025562, Jan. 9, 2008, International Preliminary Report on Patentability.
PCT/US2006/025562, Oct. 31, 2007, International Search Report with Written Opinion.
PCT/US2010/056482, May 24, 2012, International Preliminary Report on Patentability.
PCT/US2010/056482, Mar. 14, 2011, International Search Report and Written Opinion.
PCT/US2011/026139, Sep. 7, 2012, International Preliminary Report on Patentability.
PCT/US2011/026139, Nov. 22, 2011, International Search Report and Written Opinion.
PCT/US2011/034747, Jul. 28, 2011, International Search Report and Written Opinion.
PCT/US2012/023689, Aug. 15, 2013, International Preliminary Report on Patentability.
PCT/US2012/023689, Sep. 12, 2012, International Search Report and Written Opinion.
PCT/US2012/060610, May 1, 2014, International Preliminary Report on Patentability.
PCT/US2012/060610, Mar. 29, 2013, International Search Report and Written Opinion.
PCT/US2015/012463, Aug. 4, 2016, International Preliminary Report on Patentability.
PCT/US2015/012463, May 13, 2015, International Search Report and Written Opinion.
PCT/US2017/047905, Mar. 7, 2019, International Preliminary Report on Patentability.
PCT/US2017/047905, Dec. 4, 2017, International Search Report and Written Opinion.
PCT/US2021/015048, Apr. 5, 2022, International Preliminary Report on Patentability Chapter II.
PCT/US2021/015048, Jul. 1, 2021, International Search Report and Written Opinion.

(56) References Cited

OTHER PUBLICATIONS

PCT/US2021/015073, Apr. 1, 2022, International Preliminary Report on Patentability Chapter II.
PCT/US2021/015073, May 17, 2021, International Search Report and Written Opinion.
TW 106128439, Mar. 5, 2021, Taiwanese Office Action.
TW 110140608, Mar. 15, 2022, Taiwanese Office Action.

* cited by examiner

COMPACT, HIGH SPEED ELECTRICAL CONNECTOR

RELATED APPLICATIONS

This application claims priority to and the benefit of Chinese Patent Application Serial No. 202022135407.9, filed on Sep. 25, 2020. The entire contents of these applications are incorporated herein by reference in their entirety.

FIELD

This application relates to electrical connectors, and in particular to an electrical connector for providing an electrical connection between electronic systems.

BACKGROUND

Electrical connectors are used to provide electrical connections between different electronic systems through conductive terminals. In certain applications, an electrical connector may provide an electrical connection between a first electronic system, such as a motherboard, and a second electronic system, such as a daughter card. Tail portions of the conductive terminals of the electrical connector are electrically connected to conductive portions of the first electronic system by, for example, soldering.

The electrical connector may act as a female connector for interfacing directly with conductive portions on or near the edge of the second electronic system, such as a daughter card, such that the conductive portions of the second electronic system are in contact with contact portions of the corresponding conductive terminals of the electrical connector. In this way, the conductive portions of the second electronic system may be electrically connected to the corresponding conductive portions of the first electronic system via the conductive terminals of the electrical connector, thereby establishing the electrical connection between the first electronic system and the second electronic system.

In other system configurations, a connector mounted to an electronic system may form interface indirectly with the second electronic system through a cable. The cable may be terminated with a plug connector that mates with a plug connector attached to a cable that is in turn connected to the electronic system. Electrical connections to the first electronic are nonetheless established through the conductive terminals of the connector mounted to the first electronic system.

BRIEF SUMMARY

Aspects of the present disclosure relate to compact, high speed electrical connectors with improved signal integrity.

Some embodiments relate to an electrical connector. The electrical connector may include a front housing member comprising a front member and a cover member mounted to a rear of the front member; a plurality of terminals arranged in the front housing member; and a bridging member comprising portions extending through the cover member and engaging a subset of the plurality of terminals.

In some embodiments, the bridging member may provide a conductive or partially conductive path among ground terminals of the plurality of terminals.

In some embodiments, the bridging member may be made of an electrically lossy material.

In some embodiments, the plurality of terminals may be arranged in two terminal rows mutually opposed and spaced apart, with the terminals in each of the terminal row aligned therein.

In some embodiments, the two terminal rows may be spaced apart in a manner that the terminals are offset from each other or aligned with each other along an arrangement direction.

In some embodiments, at least a portion of the plurality of terminals each may include a contact portion, a tail portion, and a body portion extending between the contact portion and the tail portion. For each of the at least a portion of the plurality of terminals, an accommodation space may form adjacent the body portion.

In some embodiments, a dimension of the accommodation space may match with a cross-sectional dimension of the cover member such that the cover member can be received in the accommodation space.

In some embodiments, the cover member may be fused to the front housing member and retain the at least a portion of the plurality of terminals in the front housing member.

In some embodiments, the cover member may include a recess. The bridging member may be disposed in the recess such that an outer surface of the cover member is approximately flush with an outer surface of the front member.

In some embodiments, the plurality of terminals may include signal terminals and ground terminals. The ground terminals may form the subset of the plurality of terminals. The ground terminals may include protruding portions extending from the body portions of the ground terminals into respective accommodation spaces.

Some embodiments relate to an electrical connector. The electrical connector may include a front housing member; a plurality of terminals disposed in a row in the front housing member, the plurality of terminals each comprising a contact portion, a tail portion, a body portion extending between the contact portion and the tail portion, and an accommodation space in parallel to the body portion, the plurality of terminals comprising ground terminals comprising protrusion portions protruding into respective accommodation spaces; and a lossy member comprising slots receiving the protrusion portions of the ground terminals.

In some embodiments, the front housing member may include top and bottom faces opposite each other, left and right side faces opposite each other, and front and rear side faces opposite each other, the front side face comprising a socket, the rear side face comprising a cavity. The electrical connector may include a cover member disposed in the cavity of the rear side face of the front housing member and fused to the front housing member.

In some embodiments, the cover member may include slots. The slots of the lossy member may be accessible via the slots of the cover member.

In some embodiments, the protruding portions of the ground terminals may protrude into the slots of the cover member.

In some embodiments, the lossy member may include a plurality of pairs of ribs. The slots of the lossy member may be between pairs of the plurality of pairs of ribs.

In some embodiments, the protruding portions of the ground terminals may be sandwiched between respective pairs of the plurality of pairs of ribs whereby the ground terminals are connected to the lossy member.

In some embodiments, the cover member may include a recess for receiving the lossy member.

Some embodiments relate to a method of manufacturing an electrical connector comprising a plurality of terminals each comprising a contact portion, a tail portion, and a body portion extending between the contact portion and the tail portion. The method may include inserting the plurality of terminals into a front housing member through an opening in a rear of the front housing; inserting a cover member into the opening in the rear and securing the cover member to the front housing; and filling a cavity of the cover member with lossy material.

In some embodiments, the cover member may be secured to the front housing member by a hot melt process.

In some embodiments, the filling the cavity of the cover member with the lossy material may include before or after the cover member is attached, molding the lossy material into the cavity, or inserting a member molded from the lossy material into the cavity.

Some embodiments relate to an electrical connector. The electrical connector may include a front housing member; a plurality of terminals may be arranged in the front housing member, the plurality of terminals comprising signal terminals and ground terminals; a cover member mounted to the front housing member; and a bridging member disposed in the cover member and connecting the ground terminals together.

In some embodiments, the bridging member may provide a conductive or partially conductive path among the ground terminals which may reduce electrical resonances.

In some embodiments, the bridging member may be made of an electrically lossy material.

In some embodiments, the bridging member may be molded to the cover member.

In some embodiments, the bridging member may be made as a separate member and may be mounted to the cover member.

In some embodiments, the cover member may electrically isolate the signal terminals from the bridging member.

In some embodiments, the plurality of terminals may be arranged in one or more terminal rows in the front housing member, with the terminals in each of the terminal rows aligned therein.

In some embodiments, the plurality of terminals may be arranged in two terminal rows mutually opposed and spaced apart, with the terminals in each of the terminal row aligned therein.

In some embodiments, the two terminal rows may be spaced apart in a manner that the terminals may be offset from each other or aligned with each other along an arrangement direction.

In some embodiments, at least one of the one or more terminal rows may include ground terminals and a plurality of pairs of signal terminals, and the ground terminals may separate the plurality of pairs of signal terminals from each other.

In some embodiments, each terminal in each of the at least one terminal row may include a contact portion, a tail portion and a body portion extending between the contact portion and the tail portion, and the body portion may form an accommodation space.

In some embodiments, the cover member may include at least one cover member, a dimension of the accommodation space of one terminal row of the at least one terminal row may match with a cross-sectional dimension of a corresponding cover member of the at least one cover member, such that the corresponding cover member can be received in the accommodation space of the one terminal row.

In some embodiments, the corresponding cover member may retain the one terminal row in the front housing member when received in the accommodation space of the one terminal row.

In some embodiments, the front housing member may include a first cavity, and the corresponding cover member may retain the one terminal row in the first cavity.

In some embodiments, an outer surface of the corresponding cover member may be approximately flush with that of the front housing member.

In some embodiments, each of the ground terminals may further include a protruding portion extending from the body portion of the ground terminal into the accommodation space.

In some embodiments, each of the at least one cover member may include a first set of slots, and at least a portion of the bridging member may be accessible via the first set of slots.

In some embodiments, the protruding portion of each of the ground terminals may be inserted into the bridging member through a corresponding one of the first set of slots in the cover member, when the corresponding cover member may be received in the accommodation space.

In some embodiments, the bridging member may further include a plurality of pairs of ribs extending therefrom, each pair of the plurality of pair of ribs may define a slot therebetween, and each pair of the plurality of pairs of ribs may be inserted in a corresponding one of the first set of slots in the cover member and may be accessible via the corresponding slot.

In some embodiments, the protruding portion of each of the ground terminals may be sandwiched between a corresponding pair of the plurality of pairs of ribs, whereby each of the ground terminals may be connected to the bridging member.

In some embodiments, the cover member may further include a first recess recessed into the cover member for receiving the bridging member.

In some embodiments, the corresponding cover member may be secured to the front housing member by a hot melt process.

In some embodiments, the corresponding cover member may include a second set of slots, and the front housing member may include a first set of protrusions extending into the first cavity and may be capable of mating with the second set of slots.

In some embodiments, the corresponding cover member may further include a thermal melt bar capable of being heated and melted to flow into the second set of slots so as to secure the corresponding cover member to the front housing member, when the first set of protrusions mate with the second set of slots.

These techniques may be used alone or in any suitable combination. The foregoing summary is provided by way of illustration and is not intended to be limiting.

BRIEF DESCRIPTION OF DRAWINGS

The above and other aspects of the present disclosure will be more thoroughly understood and appreciated below when read in conjunction with the appended drawings. It should be noted that the appended drawings are only schematic and are not drawn to scale. In the appended drawings.

LIST OF REFERENCE NUMERALS

Figure 1A:
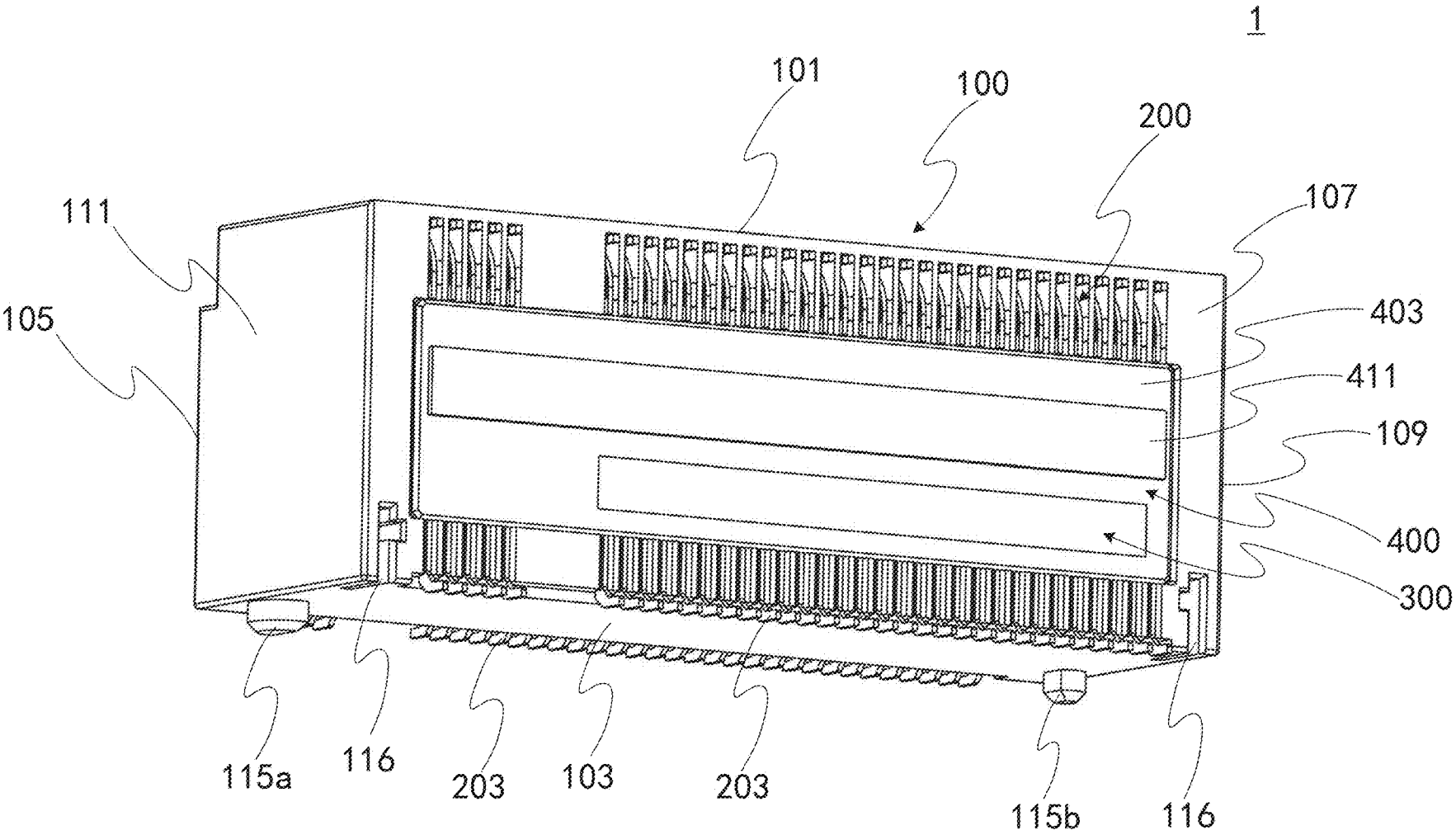
FIG. 1A is a perspective view of a right triangle connector, according to some embodiments.

1 electrical connector
100 front housing member
101 top face
103 bottom face
105 front side face
107 rear side face
109 left side face
111 right side face
113*a* first socket
113*b* second socket
115*a* first positioning protrusion
115*b* second positioning protrusion
116 mounting slot
117*a* first cavity
118*a* first opening
119*a* terminal slot
121*a* a first set of protrusions
200 terminals
200*a* a first terminal row
200*b* a second terminal row
201 contact portion
203 tail portion
205 body portion
207 accommodation space
209 protruding portion
210 ground terminal
220 first signal terminal
230 second signal terminal
300 bridging member
301 first surface
303 second surface
305*a*, 305*b* ribs
307 slot
400 cover member
401 first surface
403 second surface
405 first recess
407 a first set of slots
409 a second set of slots
411 hot melting bar.

DETAILED DESCRIPTION

Described herein is a compact, high speed electrical connector. The inventors have recognized techniques to simplify the assembly of the electrical connector and reduce the cost thereof. These techniques may be used alone or in combination. In some embodiments, the electrical connector may include a front housing member, signal and ground terminals disposed in a row in the front housing member, a cover member mounted to a rear of the front housing member, and a lossy member disposed in the cover member and contacting the ground terminals.

In some embodiments, the lossy member may be disposed in a recess of the cover member.

In some embodiments, portions of the lossy member may extend through the cover member to engage ground terminals. The ground terminals may be connected through the lossy member, for example, by inserting protruding portions of the ground terminals between the ribs of the lossy member through slots in the cover member.

In some embodiment, the cover member may be disposed in the accommodation spaces formed adjacent to body portions that are between contact portions and tails of the terminals, which may enable mounting the cover member in the front housing member without substantially changing external dimensions of the front housing member and thus without increasing the space occupied by the electrical connector on an electronic system. In some embodiments, the terminals may be retained in place by the cover member, which may eliminate the need to overmold the front housing member around the terminals or the need to provide an additional terminal retention mechanism. Further, intermediate portions of signal terminals may be securely retained within the front housing member without barbs or other features that change the width or other physical characteristics such that a relatively long intermediate portion is of uniform dimensions. In some embodiments, the cover may be fused to the front housing portion, such as by hot melting, for example. Securing the cover member to the front housing member may improve the stability of attachment of the bridging member to the electrical connector.

Preferred embodiments of the present disclosure are described in detail below in conjunction with some examples. It should be appreciated by the skilled person in the art that these embodiments are not meant to form any limitation on the present disclosure.

FIGS. 1A to 1H illustrate an electrical connector 1 according to a preferred embodiment of the present disclosure. As shown in FIGS. 1A to 1F, the electrical connector 1 is a right angle connector and may include a front housing member 100 and a plurality of terminals 200 arranged in the front housing member 100. The front housing member 100 may have a substantially block-shaped body and may include a top face 101, a bottom face 103 opposite to the top face 101, and four side faces extending between the top face 101 and the bottom face 103, i.e., front side face 105, rear side face 107, left side face 109 and right side face 111. Examples of materials that are suitable for forming the front housing member 100 include, but are not limited to, plastic, nylon, liquid crystal polymer (LCP), polyphenyline sulfide (PPS), high temperature nylon or polyphenylenoxide (PPO) or polypropylene (PP).

Figure 1B:
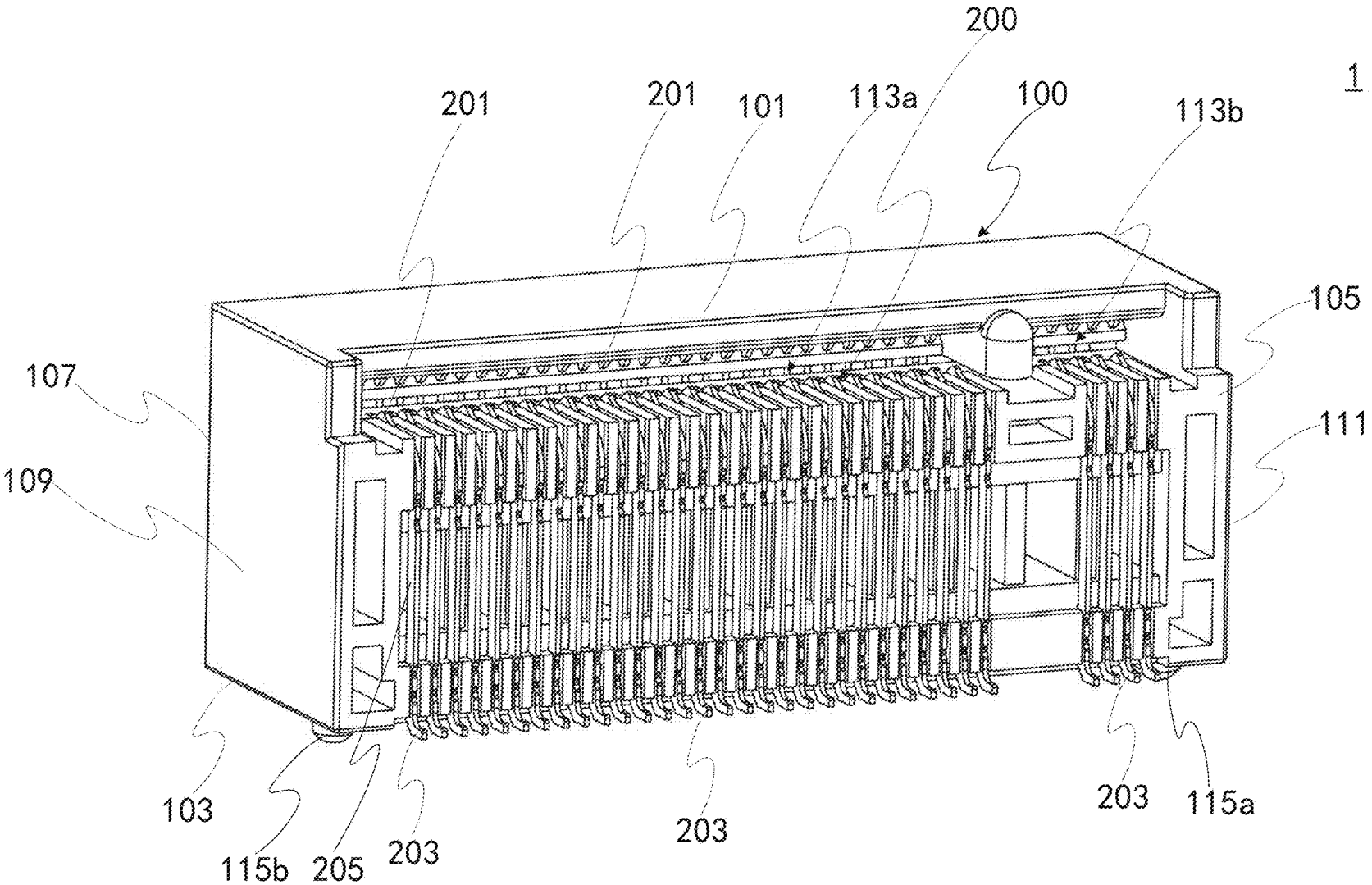
FIG. 1B is another perspective view of the right angle connector shown in FIG. 1A.
Figure 1C:
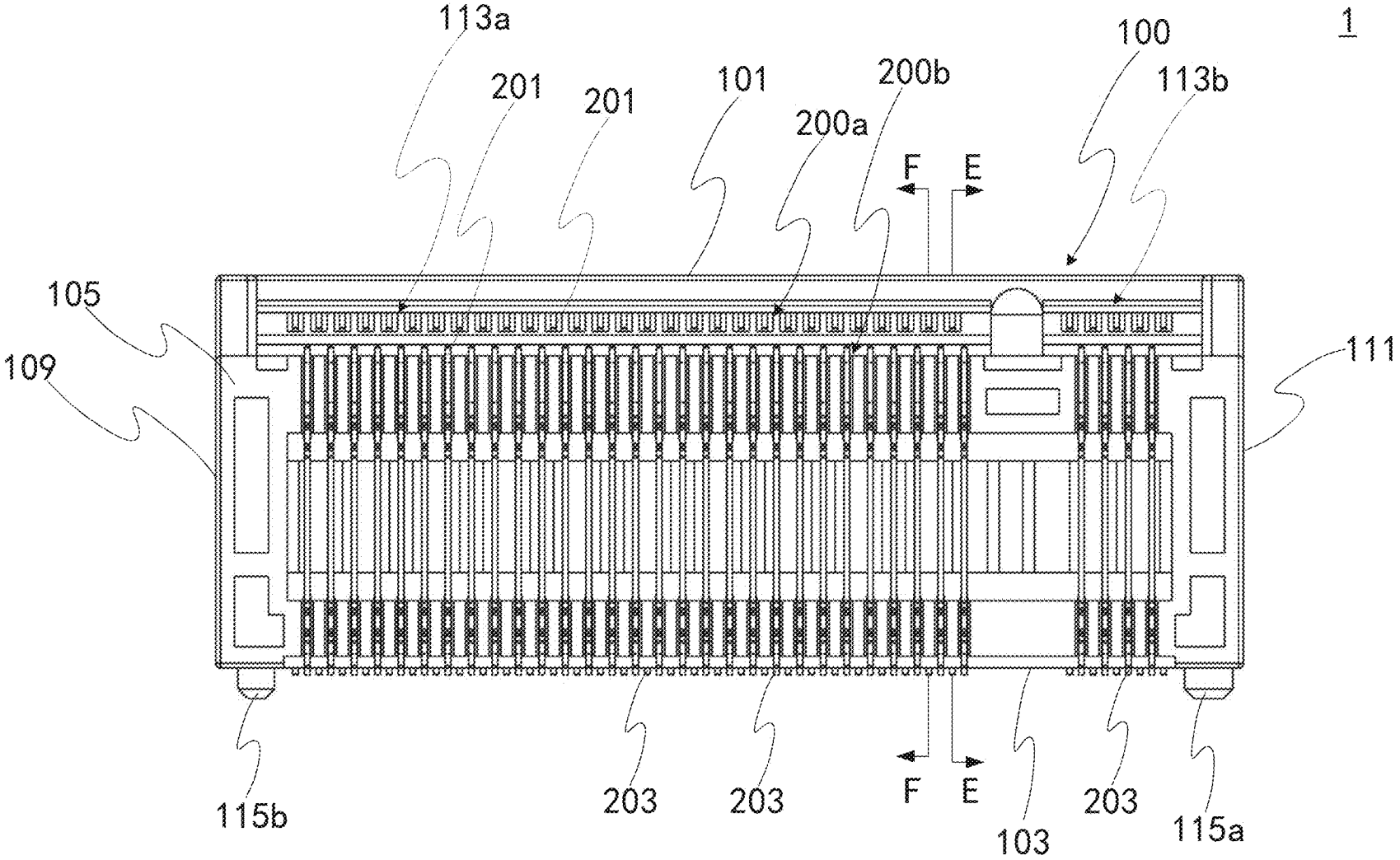
FIG. 1C is a front view of the right angle connector shown in FIG. 1A.
Figure 1D:
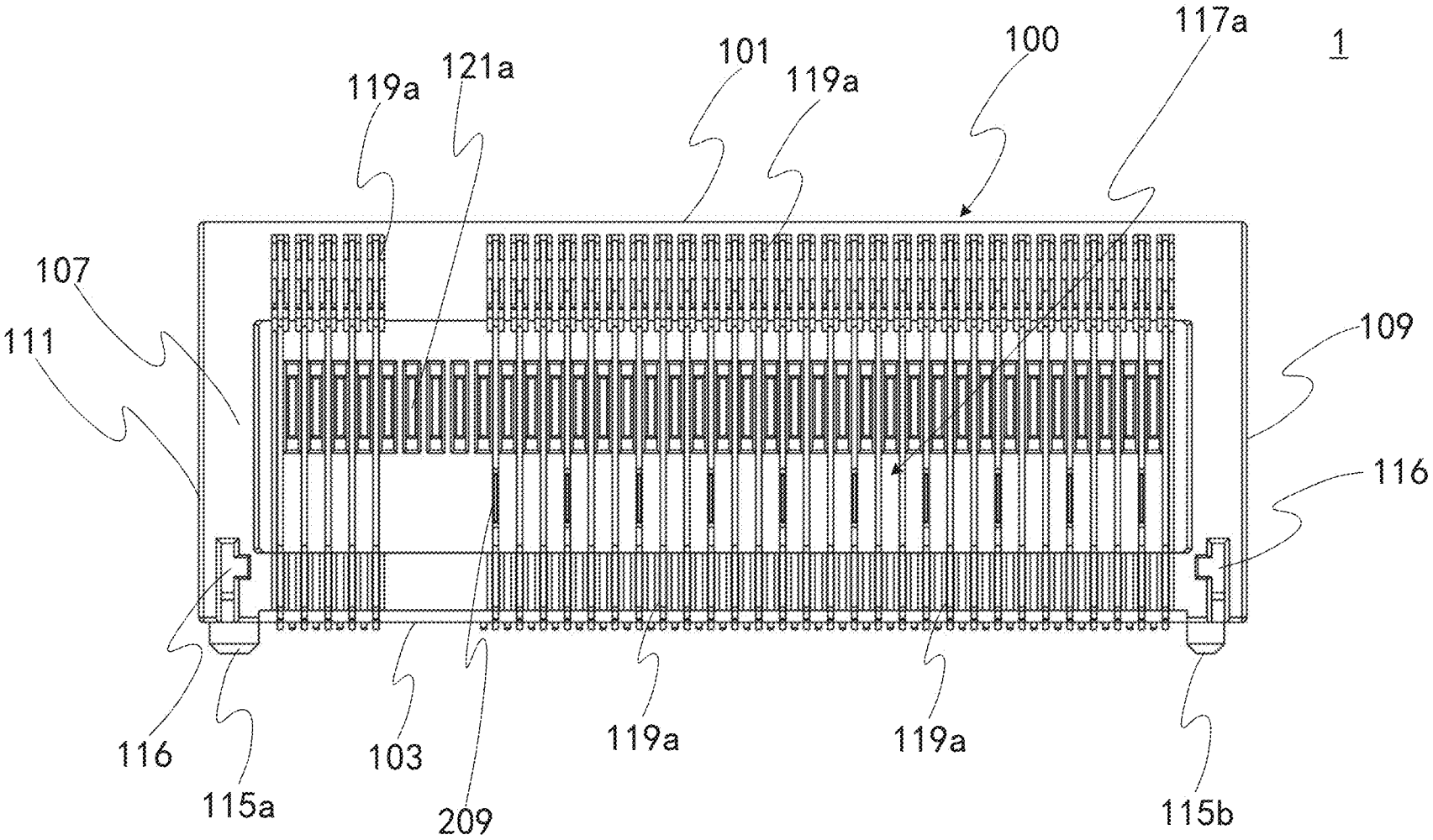
FIG. 1D is a rear view of the right angle connector shown in FIG. 1A with the cover member and the bridging member removed.
Figure 1F:
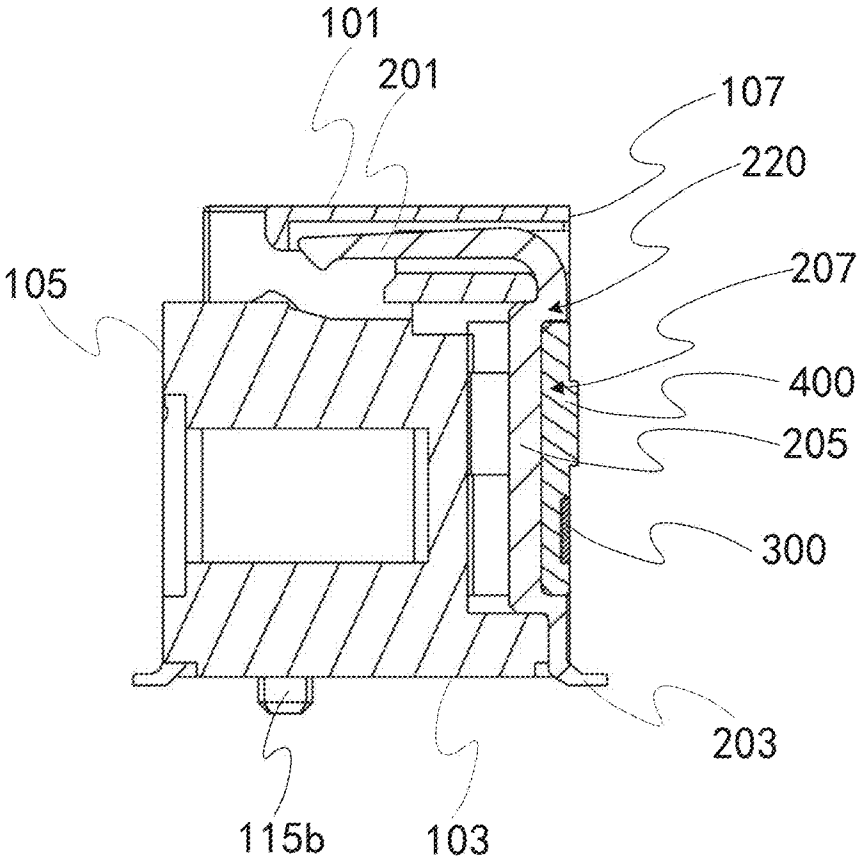
FIG. 1F is a cross-sectional view along line F-F in FIG. 1C.
Figure 1E:
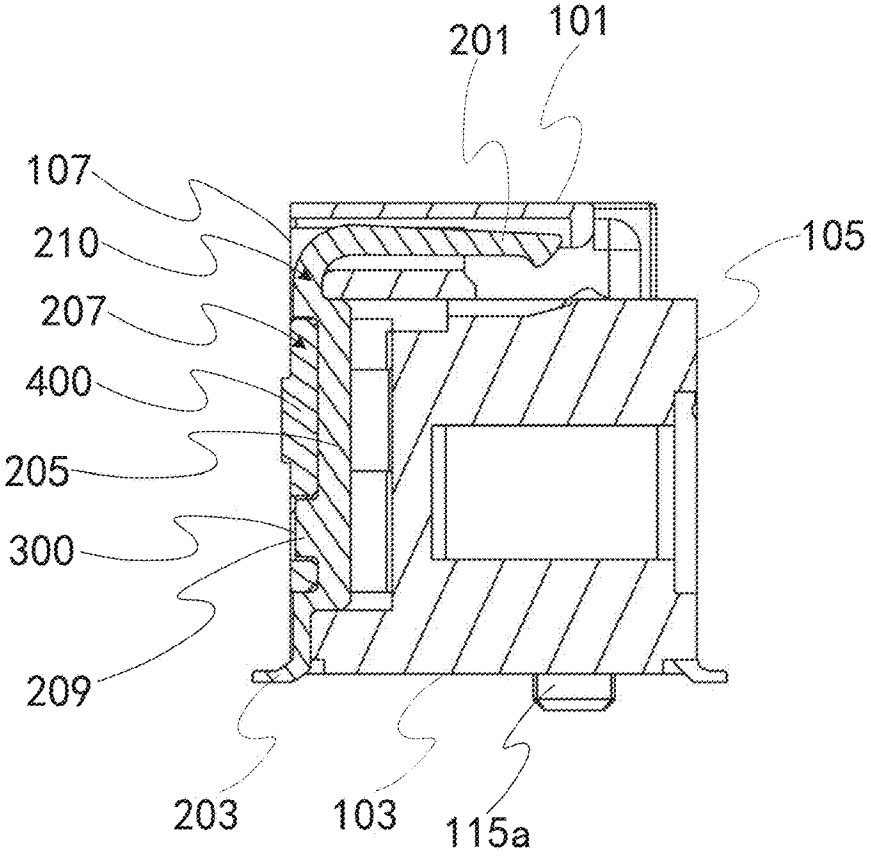
FIG. 1E is a cross-sectional view along line E-E in FIG. 1C.
Figure 1G:
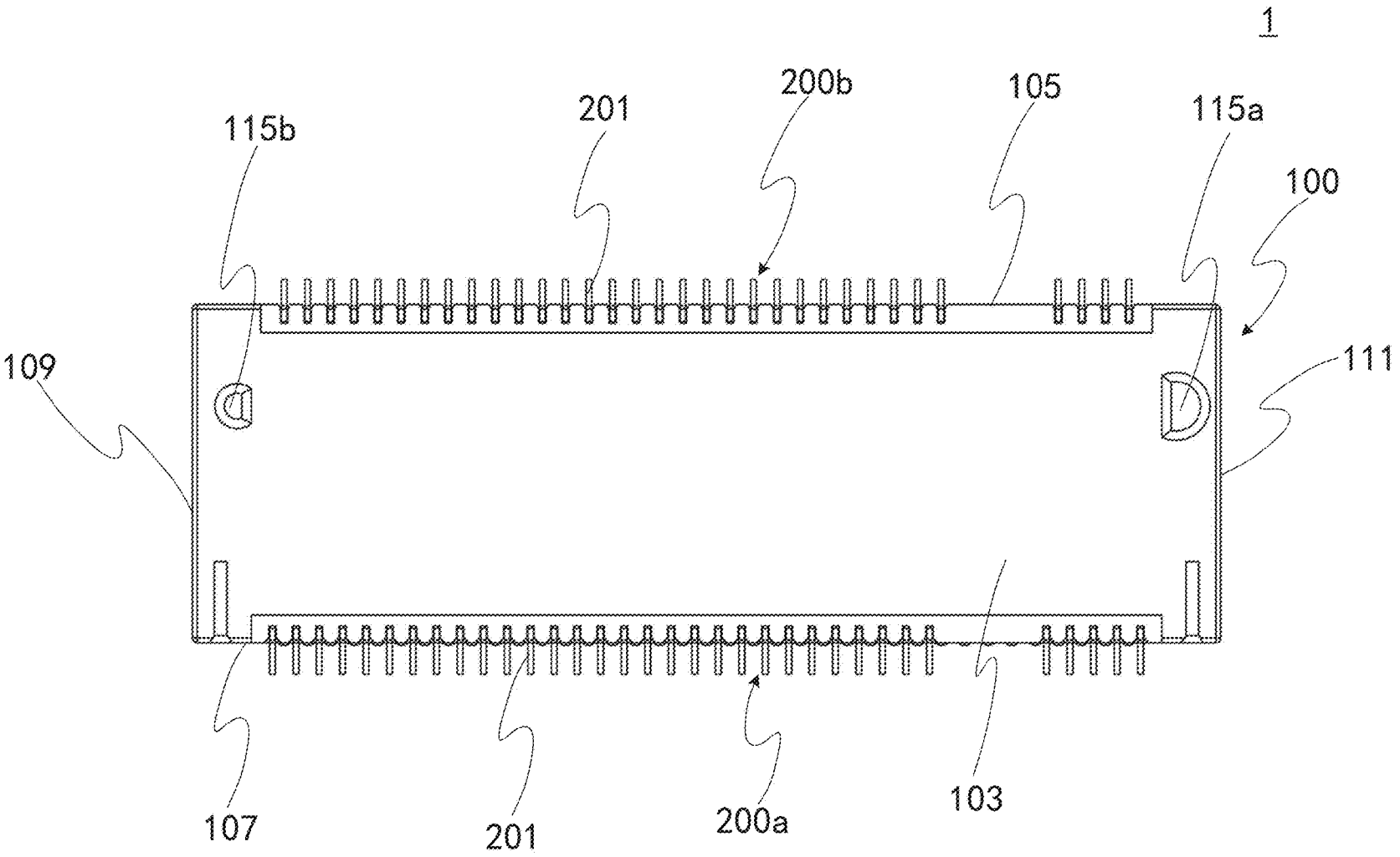
FIG. 1G is a bottom view of the right angle connector shown in FIG. 1A.
Figure 1H:
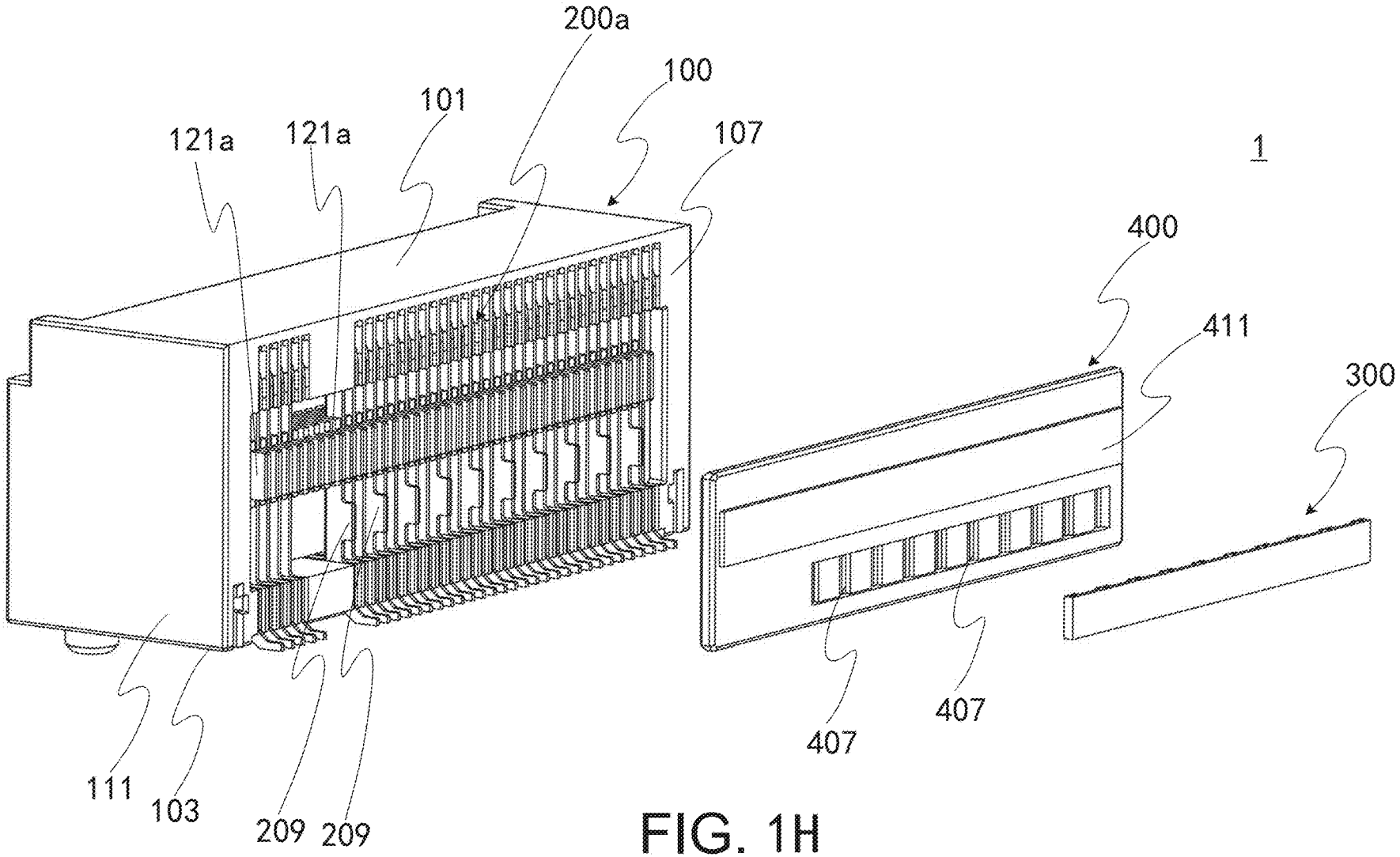
FIG. 1H is an exploded view of the right angle connector shown in FIG. 1A.

The plurality of terminals 200 may be housed in the front housing member 100. Each of the plurality of terminals 200 may be formed of a conductive material. Conductive materials that are suitable for forming the terminals 200 may be a metal, such as copper, or a metal alloy, such as copper alloy. The plurality of terminals 200 may be configured to establish an electrical connection between a first electronic system, such as a motherboard, and a second electronic system, such as a daughter card. Each of the plurality of terminals 200 may include a contact portion 201, a tail portion 203 and a body portion 205 extending between the contact portion 201 and the tail portion 203 (FIGS. 1D to 1F). The terminal 200 may be bent such that the contact portion 201 and the tail portion 203 can extend at a substantially right angle relative to the body portion 205 respectively. The tail portion 203 may be configured to mount (for example, by soldering) onto the first electronic system. The contact portion 201 may be configured to establish an electrical contact with a conductive portion of the second electronic system.

The terminals 200 may be arranged in rows, with the terminals in each terminal row aligned therein. As shown in FIG. 1C, when the terminals 200 are arranged in the front housing member 100, the terminals 200 are arranged in two rows, i.e., a first terminal row 200*a* and a second terminal row 200*b*, which are mutually opposed and spaced apart, with the terminals in each terminal row aligned therein. The first terminal row 200*a* and the second terminal row 200*b* can be spaced apart in a manner that the terminals 200 are offset (FIG. 1C) from each other or aligned (not shown) with each other along an arrangement direction. The first terminal row 200*a* and the second terminal row 200*b* being offset from each other along the arrangement direction may increase a distance between the terminals in the first terminal row 200*a* and the second terminal row 200*b* so as to reduce the scattering between high speed signals, thereby improving the electrical performance of the electrical connector 1. The conductive portions of the second electronic system may be inserted between the terminals in the first terminal row 200*a* and the second terminal row 200*b*, such that the conductive portions of the second electronic system are disposed in contact with the contact portions 201 of the corresponding terminals 200. It should be appreciated that the terminals 200 of the electrical connector 1 may also be arranged in any other numbers of rows.

With continuing reference to FIGS. 1A to 1G, when the terminals 200 are held in the front housing member 100, the tail portions 203 of the terminals 200 may be arranged to extend out from the bottom face 103 (which may also be referred to as the "mounting face") of the front housing member 100 so as to mount onto the first electronic system, such as a motherboard. As shown, the tail portions 203 of the terminals 200 in the first terminal row 200*a* and the second terminal row 200*b* may be bent in opposite directions so as to be connected to the corresponding conductive portions of the first electronic system. The connection can be achieved by soldering or any other suitable means. The contact portions 201 of the terminals 200 in the first terminal row 200*a* and the second terminal row 200*b* are accessible through sockets in the front side face 105 of the front housing member 100. The conductive portions of the second electronic system may be inserted between the terminals in the first terminal row 200*a* and the second terminal row 200*b*, such that the conductive portions of the second electronic system are arranged in contact with the contact portions 201 of the corresponding terminals 200. In this way, the conductive portions of the second electronic system may be electrically connected to the corresponding conductive portions of the first electronic system, such as a motherboard, via the terminals 200, thereby establishing an electrical connection between the second electronic system and the first electronic system. The first electronic system and the second electronic system may communicate with each other through the electrical connector 1 using a standardized protocol, such as a PCI protocol.

One of the four side faces of the front housing member 100 may have at least one socket, such that the contact portion 201 of each of the plurality of terminals 200 is accessible through the socket. Such a side face may also be referred to as the "interfacing face". The second electronic system, such as a daughter card, may be interfaced with the front housing member 100 via the interfacing face. For example, the conductive portions of the second electronic system may be inserted between the terminals in the first terminal row 200*a* and the second terminal row 200*b* through the socket in the interfacing face, such that the conductive portions of the second electronic system are arranged in contact with the contact portion 201 of the corresponding terminals 200. As shown in FIGS. 1B and 1C, the front side face 105 of the front housing member 100 may have two sockets, i.e., a first socket 113*a* and a second socket 113*b*, with the contact portions 201 of the respective terminals in the first terminal row 200*a* and the second terminal row 200*b*, which are mutually opposed and spaced apart, positioned in the first socket 113*a* and the second socket 113*b*, such that the contact portions 201 of the plurality of terminals 200 are accessible through the first socket 113*a* and the second socket 113*b*. It should be appreciated that the front side face 105 of the front housing member 100 may have any other numbers of sockets, such as one socket or more than two sockets.

The electrical connector 1 may further include a positioning mechanism provided on the front housing member 100 for ensuring the proper positioning of the electrical connector 1 on the first electronic system, such as a motherboard, when the electrical connector 1 is mounted onto the first electronic system, and for preventing the front housing member 100 from moving along a surface of the first electronic system. For example, the first positioning mechanism may be in the form of a positioning protrusion, two positioning protrusions are shown in FIGS. 1A to 1G: a first positioning protrusion 115*a* and a second positioning protrusion 115*b*. The first positioning protrusion 115*a* and the second positioning protrusion 115*b* may be provided on the bottom face 103 of the front housing member 100, near the opposite ends of the front housing member 100, respectively. However, it should be appreciated that the first positioning protrusion 115*a* and the second positioning protrusion 115*b* may also be provided at any other suitable location. The first positioning protrusion 115*a* and the second positioning protrusion 115*b* may be designed to provide a dummy-proof design to prevent the electrical connector 1 from being intentionally or unintentionally mounted in a wrong orientation on the first electronic system. As the electrical connector 1 is mounted onto the first electronic system, the first positioning protrusion 115*a* and the second positioning protrusion 115*b* may cooperate with a mating positioning mechanism (for example, a recess or hole) on the first electronic system to ensure that the electrical connector 1 is properly positioned on the first electronic system and to prevent movement of the front housing member 100 along the surface of the first electronic system. It should be appreciated that the positioning mechanism may also be in any other suitable form.

The electrical connector 1 may further include a fixing mechanism for fixing the electrical connector 1 onto the first electronic system, such as a motherboard. For example, the fixing mechanism may be in the form of a mounting slot for receiving a fixing member. In FIG. 1A are shown two mounting slots 116, which may be used to receive fixing members, such as mounting tabs. The fixing members may for example be disposed in the corresponding mounting slots 116 and protrude from the bottom face 103 of the electrical connector 1, with the protruded portions of the fixing members received by mating structures of the first electronic system, whereby the electrical connector 1 can be securely fixed onto the first electronic system. It should be appreciated that the electrical connector 1 may have any other numbers of fixing mechanisms, and/or the fixing mechanisms may be in any other suitable form.

Figure 3B:
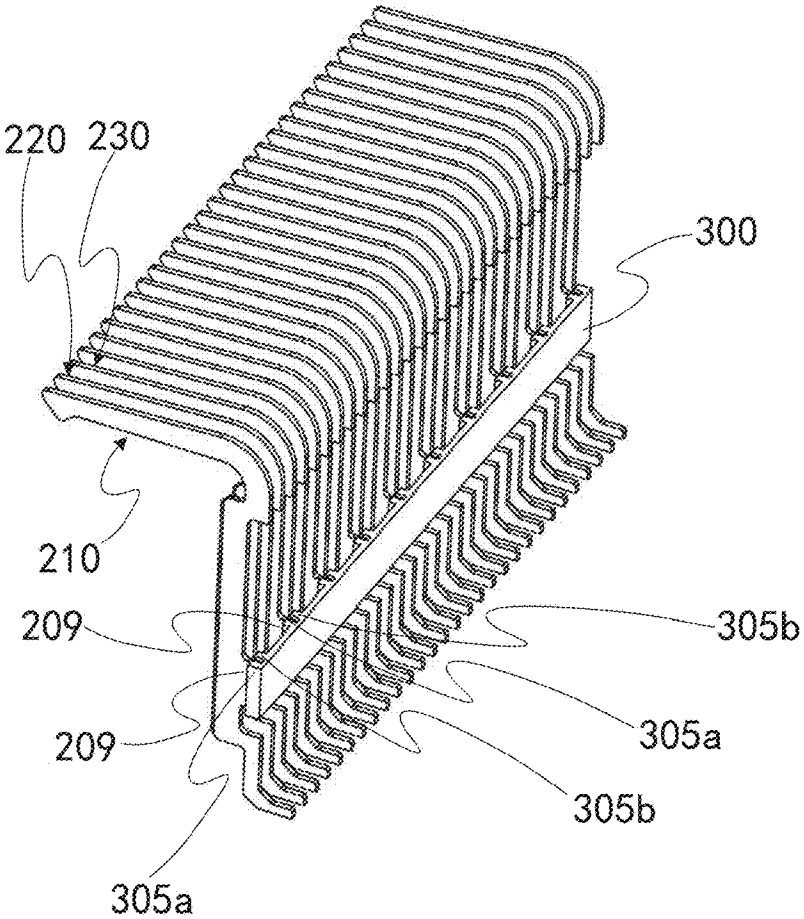
FIG. 3B is another perspective view of the terminals shown in FIG. 3A with the ground terminals connected to the bridging member.
Figure 3A:
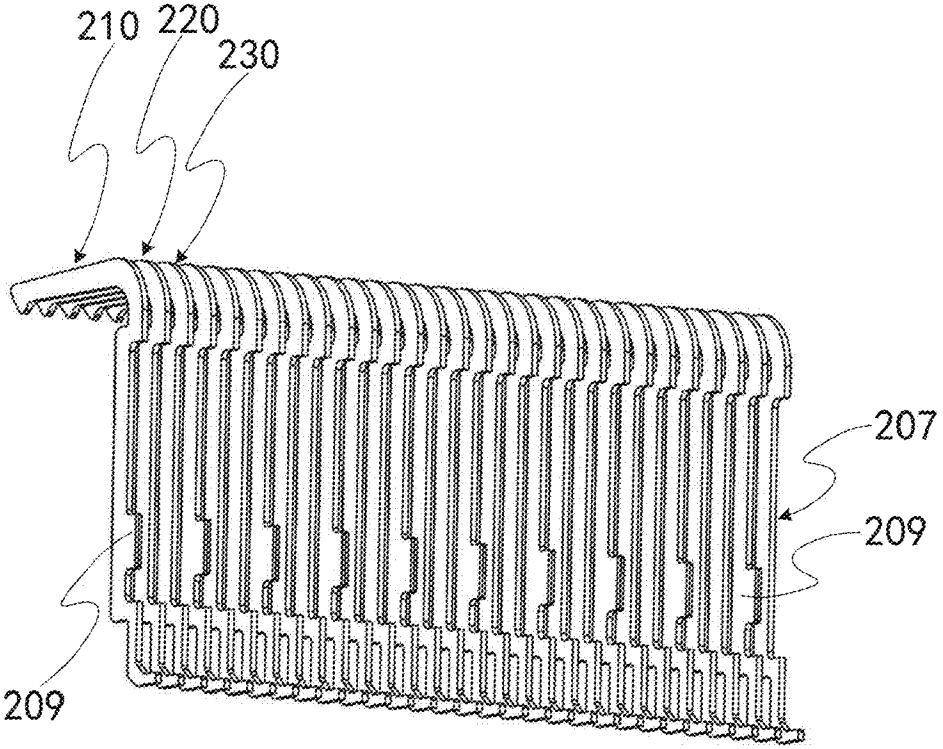
FIG. 3A is a perspective view of some of the terminals in a first terminal row of the right angle connector shown in FIG. 1A.
Figure 4C:
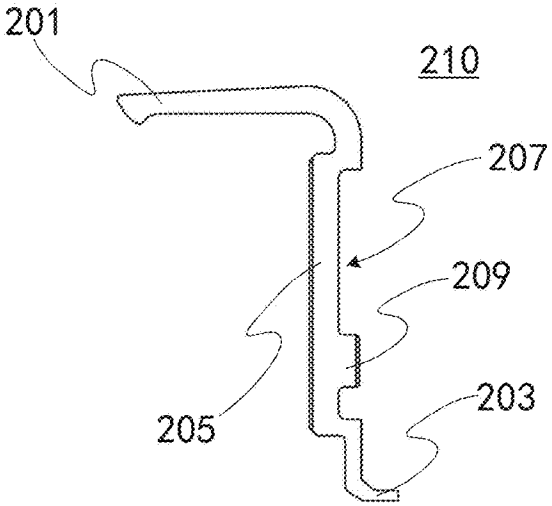
FIG. 4C is a side view of the ground terminal shown in FIG. 4B.
Figure 4E:
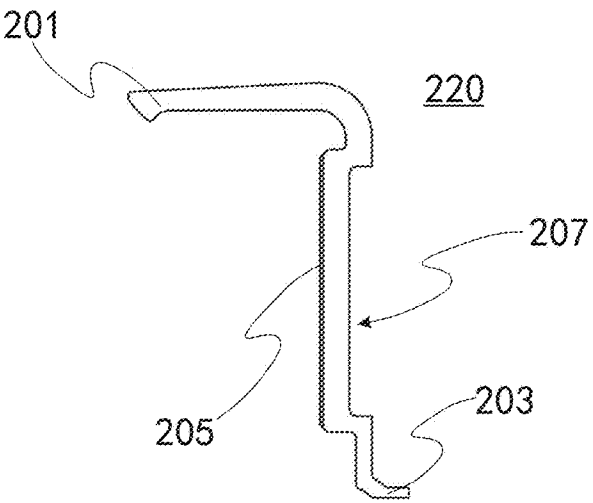
FIG. 4E is a side view of the signal terminal shown in FIG. 4D.
Figure 4B:
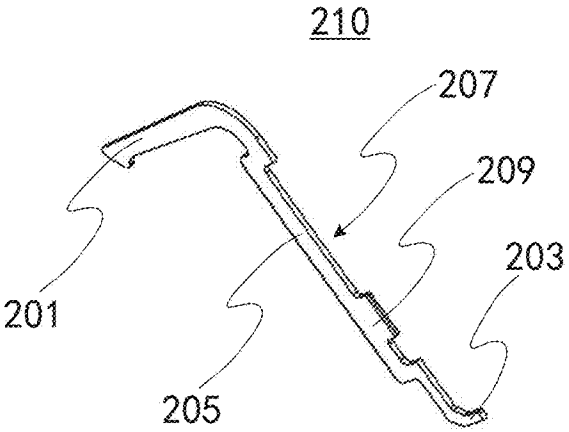
FIG. 4B is a perspective view of a ground terminal of the set of three terminals shown in FIG. 4A.
Figure 4D:
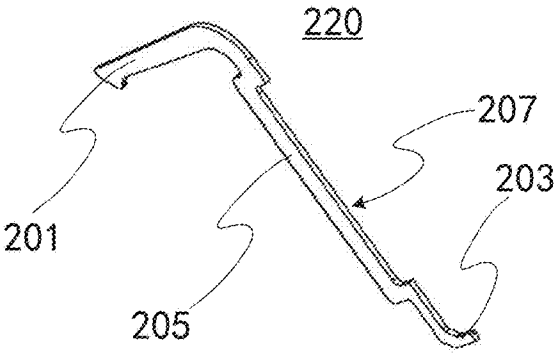
FIG. 4D is a perspective view of a signal terminal of the set of three terminals shown in FIG. 4A.
Figure 4A:
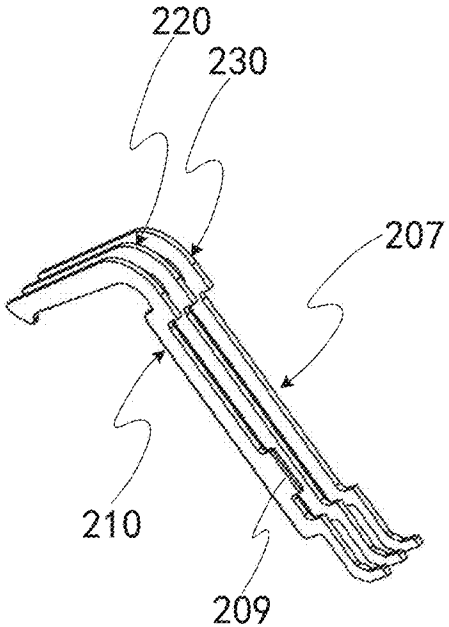
FIG. 4A is a perspective view of the set of three terminals of FIG. 3A.

At least some of the terminals 200 of the electrical connector 1 may be configured for transmitting differential signals. FIGS. 3A and 3B illustrate some of the terminals in the first terminal row 200*a*, which may include a plurality of terminal sets. FIG. 4A illustrates the leftmost set of three terminals in FIG. 3A in detail. As shown in FIG. 4A, each terminal set may include three terminals, i.e., a ground terminal ("G") 210, a first signal terminal ("S") 220 and a second signal terminal ("S") 230. The first signal terminal 220 and the second signal terminal 230 may have the same configurations. The first signal terminal 220 and the second signal terminal 230 may constitute a differential signaling pair. For example, the first signal terminal 220 may be energized by a first voltage, and the second signal terminal 230 may be energized by a second voltage complementary to the first voltage. The voltage difference between the first signal terminal 220 and the second signal terminal 230 represents a signal. The first terminal row 200*a* may include a plurality of pairs of signal terminals for transmitting signals. A ground terminal 210 may be arranged adjacent to each pair of the signal terminals to control the impedance of these terminals and to reduce crosstalk among signals, thereby improving signal integrity. These terminals are aligned in terminal rows in a "G-S-S-G-S-S . . . G-S-S" pattern as shown in FIGS. 3A and 3B, with each pair of the signal terminals sharing a ground terminal.

When transmitting high speed signals (for example, signals at frequencies up to about 25 GHz or up to about 40 GHz, up to about 56 GHz or up to about 60 GHz or up to about 75 GHz or up to about 112 GHz or higher), undesired resonances may occur within the ground terminals 210, which in turn may affect signal integrity. Therefore, it is expected to reduce the effect of resonances through changing the frequency of resonances or attenuating the energy associated with resonances.

In order to reduce the effect of resonances on the electrical performance of electrical connector 1, a bridging member 300 may be incorporated among the ground terminals 210 of the electrical connector 1 to reduce resonances. In particular, the bridging member 300 may provide a conductive or partially conductive path among the ground terminals 210 to control or damp undesired resonances that occur within the ground terminals 210 during operation of the electrical connector 1, thereby improving signal integrity. The ground terminals 210 may be connected to the bridging member 300. The signal terminals (i.e., the first signal terminals 220 and the second signal terminals 230) may be electrically isolated from the bridging member 300. In some examples, the bridging member 300 may change the frequency at which resonance occurs, such that the resonance frequency is outside an intended operating range for a differential signal transmitted via the signal terminals, thereby reducing the effect of resonances on signal integrity, in some examples, the bridging member 300 may dissipate resonant energy to reduce the effect of resonances on signal integrity.

The bridging member 300 may be formed of any suitable material. In some examples, the bridging member 300 may be formed from the same material as that used to form the ground terminal 210 or any other suitable conductive material. In some examples, the bridging member 300 may be formed from an electrically lossy material. For example, the bridging member 300 may be molded of or contain an electrically lossy material.

Materials that conduct, but with some loss, or material which by another physical mechanism absorbs electromagnetic energy over the frequency range of interest are referred to herein generally as "electrically lossy materials". Electrically lossy materials can be formed from lossy dielectric and/or poorly conductive and/or lossy magnetic materials. Magnetically lossy material can be formed, for example, from materials traditionally regarded as ferromagnetic materials, such as those that have a magnetic loss tangent greater than approximately 0.05 in the frequency range of interest. The "magnetic loss tangent" is the ratio of the imaginary part to the real part of the complex electrical permeability of the material. Practical lossy magnetic materials or mixtures containing lossy magnetic materials may also exhibit useful amounts of dielectric loss or conductive loss effects over portions of the frequency range of interest. Electrically lossy material can be formed from material traditionally regarded as dielectric materials, such as those that have an electric loss tangent greater than approximately 0.05 in the frequency range of interest. The "electric loss tangent" is the ratio of the imaginary part to the real part of the complex electrical permittivity of the material. Electrically lossy materials can also be formed from materials that are generally thought of as conductors, but are either relatively poor conductors over the frequency range of interest, contain conductive particles or regions that are sufficiently dispersed that they do not provide high conductivity or otherwise are prepared with properties that lead to a relatively weak bulk conductivity compared to a good conductor, such as copper, over the frequency range of interest.

Electrically lossy materials typically have a bulk conductivity of about 1 Siemen/meter to about 10,000 Siemens/meter and in some embodiments about 1 Siemen/meter to about 5,000 Siemens/meter. In some examples, a material with a bulk conductivity of between about 10 Siemens/meter and about 200 Siemens/meter may be used. As a specific example, a material with a conductivity of about 50 Siemens/meter may be used. However, it should be appreciated that the conductivity of the material may be selected empirically or through an electrical simulation using known simulation tools to determine a suitable conductivity that provides a suitably low crosstalk with a suitably low signal path attenuation or insertion loss.

Electrically lossy materials may be partially conductive materials, such as those that have a surface resistivity between 1 Ω/square and 100,000 Ω/square. In some examples, the electrically lossy material has a surface resistivity between 10 Ω/square and 1000 Ω/square. As a specific example, the material may have a surface resistivity of between about 20 Ω/square and 80 Ω/square.

In some examples, electrically lossy material is formed by adding to a binder a filler that contains conductive particles. In such examples, the bridging member 300 may be formed by molding or otherwise shaping the binder with filler into a desired form. Examples of conductive particles that may be used as a filler to form an electrically lossy material include carbon or graphite formed as fibers, flakes, nanoparticles, or other types of particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating materials for fibers. Coated particles may be used alone or in combination with other fillers, such as carbon flake. The binder or matrix may be any material that will set, cure, or can otherwise be used to position the filler material. In some examples, the binder may be a thermoplastic material traditionally used in the manufacture of electrical connectors to facilitate the molding of the electrically lossy material into the desired shapes and locations as part of the manufacture of the electrical connectors. Examples of such materials include liquid crystal polymer (LCP) and nylon. However, many alternative forms of binder materials may be used. Curable materials, such as epoxies, may serve as a binder. Alternatively, materials, such as thermosetting resins or adhesives, may be used.

Also, while the above-described binder materials may be used to create an electrically lossy material by forming a binder around conducting particle fillers, the disclosure is not so limited. For example, conducting particles may be impregnated into a formed matrix material or may be coated onto a formed matrix material, such as by applying a conductive coating to a plastic component or a metal component. As used herein, the term "binder" encompasses a material that encapsulates the filler, is impregnated with the filler or otherwise serves as a substrate to hold the filler.

In some embodiments, the fillers will be present in a sufficient volume percentage to allow conducting paths to be created from particle to particle. For example, when a metal fiber is used, the fiber may be present in about 3% to 40% by volume. The amount of filler may impact the conducting properties of the material.

Filled materials may be purchased commercially, such as materials sold under the trade name Celestran® by Celanese Corporation which can be filled with carbon fibers or stainless steel filaments. A lossy material, such as lossy conductive carbon filled adhesive preform, such as those sold by Techfilm of Billerica, Mass., US, may also be used. This preform can include an epoxy binder filled with carbon fibers and/or other carbon particles. The binder surrounds carbon particles, which act as a reinforcement for the preform. Such a preform may be inserted in a connector wafer to form all or part of the housing. In some examples, the preform may adhere through the adhesive in the preform, which may be cured in a heat treating process. In some examples, the adhesive may take the form of a separate conductive or non-conductive adhesive layer. In some examples, the adhesive in the preform alternatively or additionally may be used to secure one or more conductive elements, such as foil bars, to the lossy material.

Various forms of reinforcing fiber, in woven or non-woven form, coated or non-coated may be used. Non-woven carbon fiber is one suitable material. Other suitable materials, such as custom blends as sold by RIP Company, can be employed, as the present disclosure is not limited in this respect.

In some examples, the bridging member 300 may be manufactured by stamping a preform or sheet of the lossy material. For example, the bridging member 300 may be formed by stamping a preform as described above with a die having an appropriate pattern. However, other materials may be used instead of or in addition to such a preform. A sheet of ferromagnetic material, for example, may be used.

However, the bridging member 300 may also be formed in other ways. In some examples, the bridging member 300 may be formed by interleaving layers of lossy and conductive material, such as a metal foil. These layers may be rigidly attached to one another, such as through the use of epoxy or other adhesive, or may be held together in any other suitable way. The layers may be of the desired shape before being secured to one another or may be stamped or otherwise shaped after they are held together. As a further alternative, the bridging member 300 may be formed by plating plastic or other insulative material with a lossy coating, such as a diffuse metal coating.

As shown in FIGS. 1A, 1E, 1F and 1H, the electrical connector 1 may further include a cover member 400 which can be mounted to the front housing member 100 in any suitable way. The bridging member 300 may be disposed in the cover member 400 and connect the ground terminals 210 together. In other words, the cover member 400 may be mounted to the front housing member 100 such that the ground terminals 210 of the plurality of terminals 200 are connected to the bridging member 300. In this way, the bridging member 300 may provide a conductive or partially conductive path among the ground terminals 210 to control or damp undesired resonances occurring within the ground terminal 210 during operation of the electrical connector 1, thereby improving signal integrity.

Figure 5A:
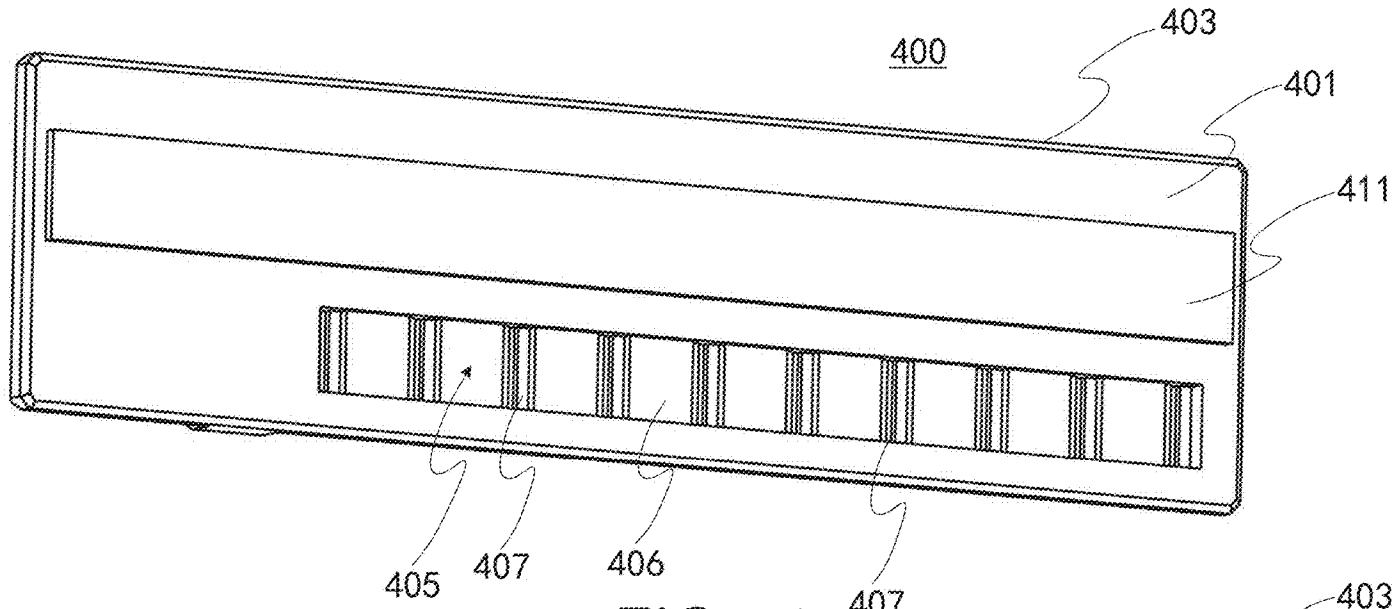
FIG. 5A is a perspective view of the cover member of the right angle connector shown in FIG. 1A.
Figure 5B:
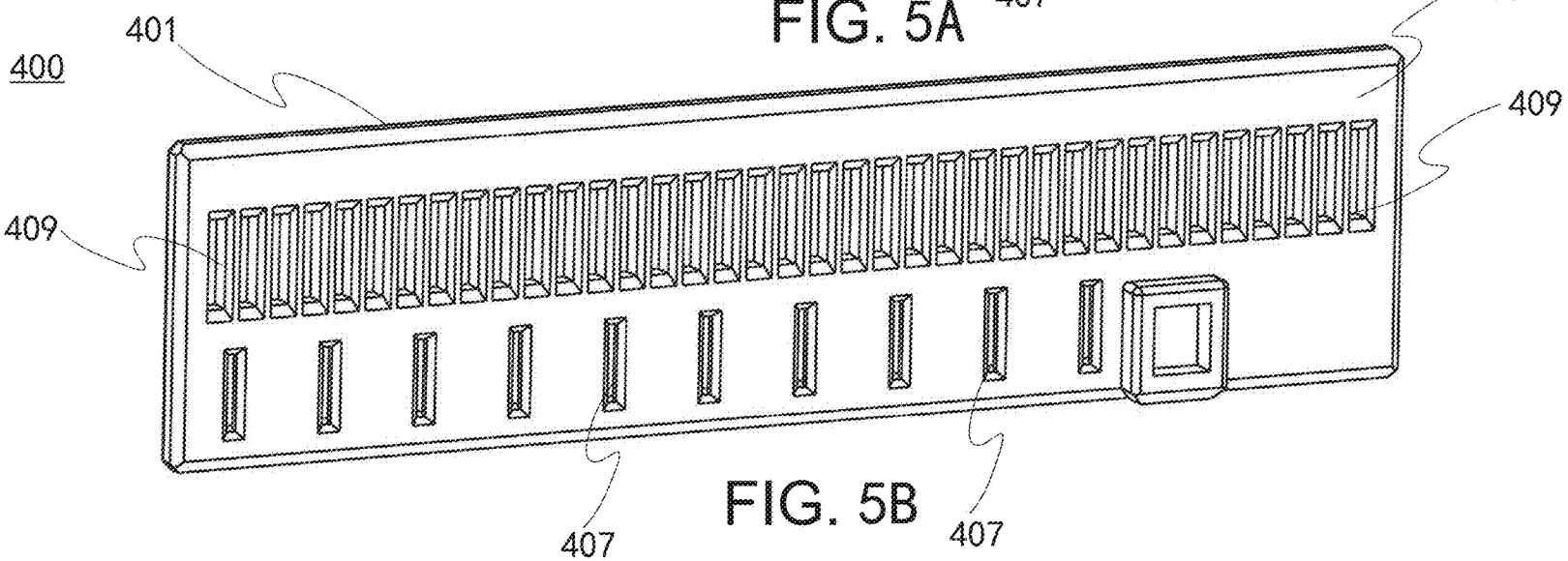
FIG. 5B is another perspective view of the cover member shown in FIG. 5A.

With continued reference to FIGS. 5A and 5B, the cover member 400 may have a plate-like shape and may include a first surface (which may also be referred to as "outer surface") 401 and a second surface (which may also be referred to as "inner surface") 403 opposite to the first surface 401. The first surface 401 faces outward when the cover member 400 is mounted to the front housing member 100, and the second surface 403 faces inward when the cover member 400 is mounted to the front housing member 100, and faces the first terminal row 200*a*, as shown in FIGS. 1A, 1E, 1F and 1H. A first recess 405 is recessed from the first surface 401 into the cover member 400 for receiving the bridging member 300. A first set of slots 407 extends from the second surface 403 opposite to the first surface 401 through the cover member 400 to the bottom face 406 of the first recess 405 such that at least a portion of the bridging member 300 is accessible via the first set of slots 407 when the bridging member 300 is disposed in the first recess 405. The cover member 400 may be made of any suitable material. In some embodiments, the cover member 400 may be made of an insulative material. Examples of insulative materials that are suitable for forming the cover member 400 include, but are not limited to, plastic, nylon, liquid crystal polymer (LCP), polyphenyline sulfide (PPS), high temperature nylon or polyphenylenoxide (PPO) or polypropylene (PP).

Figure 6A:
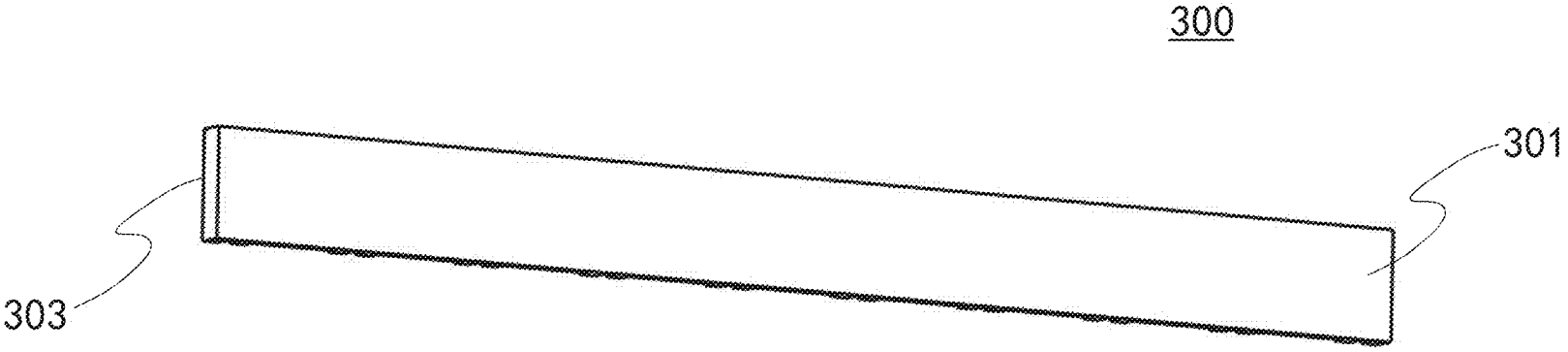
FIG. 6A is a perspective view of the bridging member of the right angle connector shown in FIG. 1A.
Figure 6B:
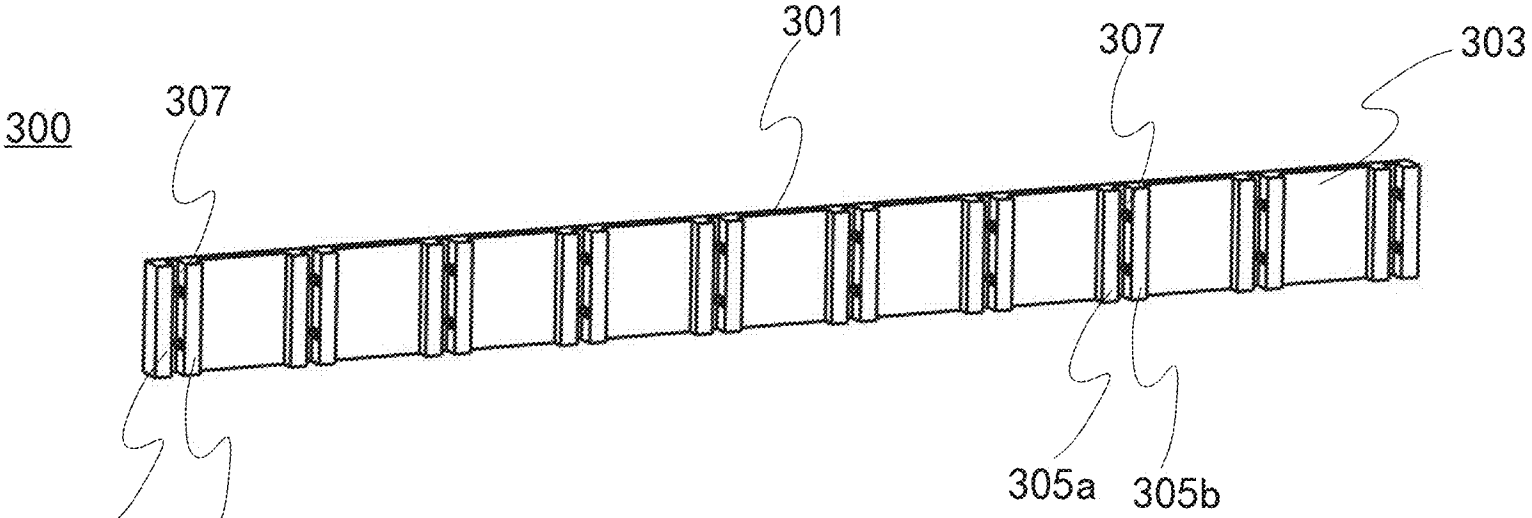
FIG. 6B is another perspective view of the bridging member shown in FIG. 6A.

The bridging member 300 may be arranged on the cover member 400 in any suitable way. As shown in FIGS. 6A and 6B, the bridging member 300 may be bar-shaped and include a first surface 301 and a second surface 303 opposite to the first surface 301. The first surface 301 faces outward and may be substantially flush with the first surface 401 of the cover member 400 when the bridging member 300 is disposed in the first recess 405 in the cover member 400. The second surface 303 faces inward when the bridging member 300 is disposed in the first recess 405 in the cover member 400. The bridging member 300 may also include a plurality of pairs of ribs 305*a* and 305*b* extending from the second surface 303. Each pair of ribs 305*a* and 305*b* defines a slot 307 therebetween fir receiving a mating portion (which will be described in detail below) of a corresponding ground terminal 210. When the bridging member 300 is disposed in the first recess 405 in the cover member 400, each pair of the plurality of pair of ribs 305*a* and 305*b* may extend into and be accessible via a corresponding slot 407 of the first set of slots 407 in the cover member 400. The mating portion of the ground terminal 210 can be inserted into the slot 307 through the slot 407. In this way, the mating portion of the ground terminal 210 can be sandwiched between a pair of ribs 305*a* and 305*b*, thereby allowing the ground terminal 210 to be connected to the bridging member 300.

In some examples, the bridging member 300 may be configured as a separate member to be installed (for example, inserted) into the first recess 405 in the cover member 400 before or after the cover member 400 is mounted to the front housing member 100. In some other examples, the bridging member 300 may be molded into the first recess 405 in the cover member 400 before or after the cover member 400 is mounted to the front housing member 100.

Turning back to FIG. 2, FIG. 2 illustrates the front housing member 100 of the electrical connector 1 in detail. The front housing member 100 may include a first cavity 117*a* for arranging the first terminal row 200*a*. The rear side face 107 of the front housing member 100 may include a first opening 118*a* configured for opening to the first cavity 117*a*. The front housing member 100 may also include a plurality of terminal slots 119*a* extending from the first cavity 117*a* for receiving the terminals in the first terminal row 200*a*. The plurality of terminal slots 119*a* may open to the sockets 113*a* and 113*b*, respectively, such that the contact portion 201 of each terminal of the first terminal row 200*a* can extend into and be accessible via the sockets. The number of terminal slots 119*a* may correspond to the number of terminals in the first terminal row 200*a*, such that each terminal in the first terminal row 200*a* can be disposed in a corresponding terminal slot 119*a*.

With continued reference to FIGS. 1A, 1E, and 1F, when the cover member 400 is fixed to the front housing member 100, the cover member 400 may retain each terminal in the first terminal row 200*a* in place in the first cavity 117*a*. As shown in FIGS. 3A and FIGS. 4A to 4E, the body portion 205 of each terminal (including the ground terminal 210, the first signal terminal 220 and the second signal terminal 230) in the first terminal row 200*a* may be configured to form an accommodation space 207. That is, when the terminals are arranged in the first terminal row 200*a*, each terminal in the first terminal row 200*a* is aligned in the terminal row and the accommodation space 207 formed by the body portion 205 of each terminal are aligned. Turning to FIGS. 1E and 1F, a dimension of the accommodation space 207 may match with a cross-sectional dimension (perpendicular to the first surface 401 or the second surface 403) of the cover member 400 such that the cover member 400 can be received in the accommodation space 207. That is, the cover member 400 may be received in the accommodation space 207 when the cover member 400 is disposed in the first cavity 17*a*. In this way, the cover member 400 can press tightly against each terminal in the first terminal row 200*a*, thereby retaining each terminal in the first terminal row 200*a* in place in the first cavity 117*a*. This eliminates the need to retain each terminal in the first terminal row 200*a* in place by overmolding the front housing member 100 around the first terminal row 200*a* or by providing an additional terminal retention mechanism, thereby simplifying the manufacture and assembly of the electrical connector and reducing the cost thereof. In addition, when the cover member 400 is disposed into the first cavity 117*a*, the first surface 401 of the cover member 400 may be substantially flush with the rear side face 107 of the front housing member 100. This allows the cover member 400 to be mounted in the front housing member 100 without substantially changing the external dimensions of the front housing member 100 and thus without increasing the space occupied by the electrical connector on the electronic system.

In order to connect the ground terminals 210 to the bridging member 300, as shown in FIGS. 3A to 3B and FIGS. 4A to 4C, the ground terminal 210 may also include a protruding portion 209 extending from the body portion 205 into the accommodation space 207, and the protruding portion 209 may be used as the aforementioned mating portion of the ground terminal 210. As shown in FIG. 1E, when the bridging member 300 is disposed in the cover member 400 and the cover member 400 is received in the accommodation space 207, each slot 407 of the first set of slots 407 in the cover member 400 is aligned with a corresponding ground terminal 210 such that the protruding portions 209 of the ground terminals 210 can be inserted into the slots 307 of the bridging member 300 through the slots 407 in the cover member 400. In this way, the protruding portion 209 of the ground terminal 210 may be sandwiched between ribs 305*a* and 305*b* such that the ground terminal 210 is connected to the bridging member 300. FIG. 3B further illustrates the ground terminal 210 in the first terminal row 200*a* connected to the bridging member 300, with the cover member removed for ease of illustration.

As shown in FIGS. 3A, 3B, 4A, 4D, and 4E, the first signal terminal 220 is devoid of a protruding portion similar to the protruding portion 209 of the ground terminal 210. As the second signal terminal 230 has the same configuration as that of the first signal terminal 220, the second signal terminal 230 is also devoid of a protruding portion similar to the protruding portion 209 of the ground terminal 210. As shown in FIG. 1F, when the bridging member 300 is disposed in the cover member 400 and the cover member 400 is received in the accommodation space 207, the cover member 400 may space the first signal terminal 220 and the second signal terminal 230 apart from the bridge member 300, thereby electrically isolating the bridge member 300 from the first signal terminal 220 and the second signal terminal 230.

Figure 2:
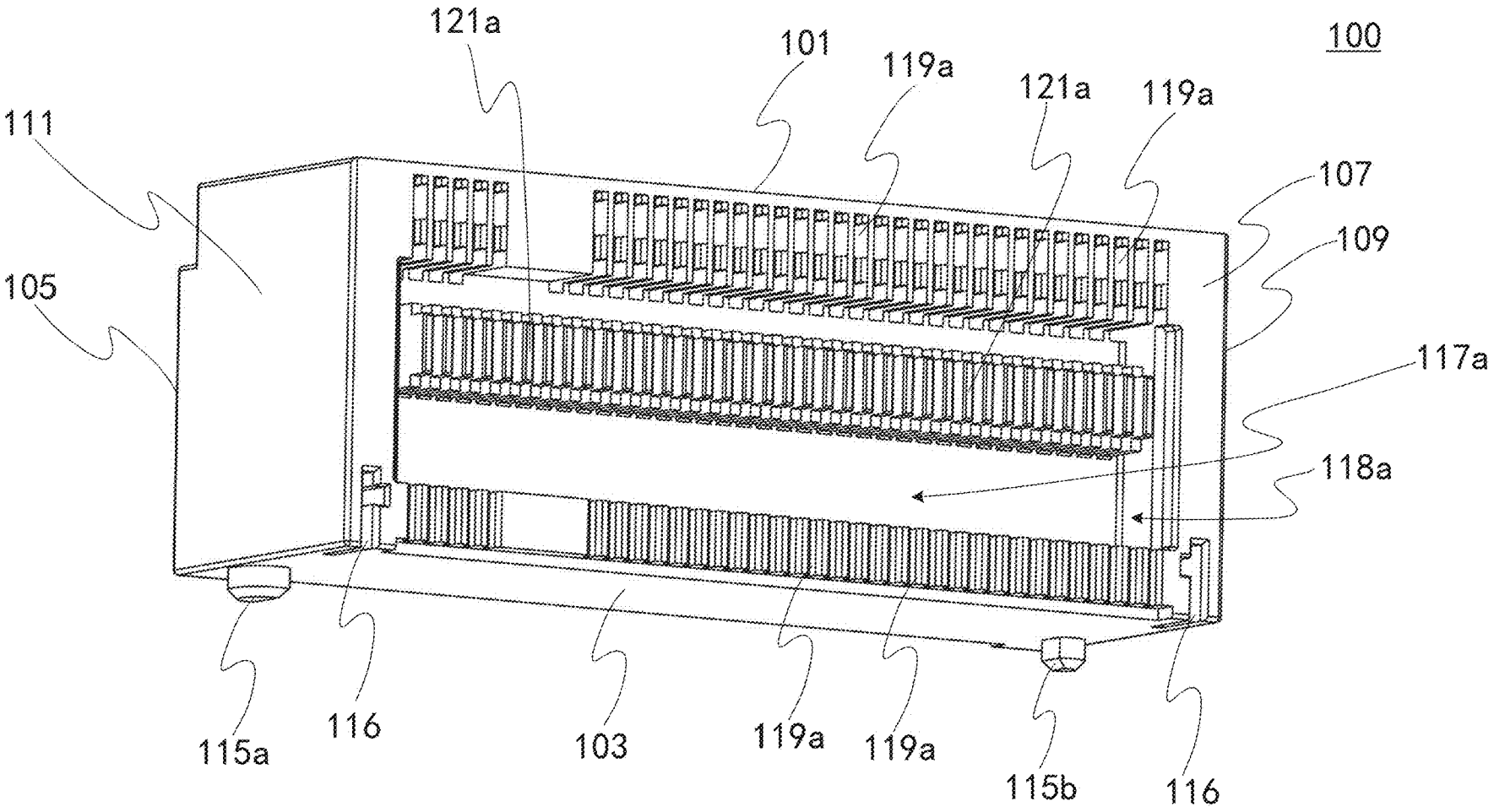
FIG. 2 is a perspective view of the front housing member of the right angle connector shown in FIG. 1A, according to some embodiments.

The cover member 400 may be secured to the front housing member 100 in any suitable way. In some examples, the cover member 400 may be secured to the front housing member 100 by a hot melt process. In particular, as shown in FIG. 2, the front housing member 100 may include a first set of protrusions 121*a* extending into the first cavity 117*a*. As shown in FIG. 5B, the cover member 400 may include a second set of slots 409 for receiving the first set of protrusions 121*a* of the front housing member 100. When the cover member 400 is received in the accommodation space 207, each of the first set of protrusions 121*a* of the front housing member 100 may be inserted into a corresponding slot of the second set of slots 409. The hot melt bar 411 is then applied to the cover member 400, and heated and melted to flow into the second set of slots 409 so as to secure the first set of protrusions 121*a* in the slots 409, thereby securing the cover member 400 to the front housing member 100. It should be appreciated that the hot melt bar 411 may be formed integrally with the cover member 400, or may be formed separately from the cover member 400 and then applied to the cover member 400. It should also be appreciated that the cover member 400 may also be secured to the front housing member 100 in other suitable manner, such as by a snap fit connection or a bolt connection.

As compared with conventional electrical connectors, the electrical connector 1 according to the preferred embodiments of the present disclosure provides at least one of the following advantages: (1) attaching the bridging member 300 to the electrical connector 1 by using the cover member 400 can simplify the manufacture and assembly of the electrical connector and reduce the cost thereof; (2) through receiving the cover member 400 in the accommodation space formed by the body portion of the terminals, it is possible to mount the cover member 400 in the front housing member 100 without substantially changing the external dimensions of the front housing member 100 and thus without increasing the space occupied by the electrical connector on the electronic system; (3) through retaining the terminals in place by the cover member 400, it is possible to eliminate the needs to overmold the front housing member 100 around the terminals or the needs to provide an additional terminal retention mechanism, thereby simplifying the manufacture and assembly of the electrical connector and reducing the cost thereof; (4) connecting the ground terminals 210 to the bridge member 300 by inserting the protruding portions 209 of the ground terminals 210 between the ribs 305*a* and 305*b* of the bridge member 300 through the slots 407 in the cover member 400, it is possible to simplify the assembly of the electrical connector and reduce the cost thereof; (5) through securing the cover member 400 to the front housing member 100 by a hot-melt process, it is possible to improve the stability of attachment of the bridging member 300 to the electrical connector 1.

Although the present disclosure is described in detail with respect to only the terminals in the first terminal row 200*a*, it should be appreciated that the electrical connector 1 may also include an additional bridging member similar to the bridging member 300 and an additional cover member similar to the cover member 400, so as to provide at least one of the above advantages. For example, the additional cover member may be mounted to the front housing member 100, and the additional bridging member may be disposed in the additional cover member and connect the ground terminals in the second terminal row 200*b* together. It should also be appreciated that the electrical connector 1 may also include only one terminal row, or may include more than two terminal rows. Accordingly, the electrical connector 1 may comprise at least one cover member.

Although the present disclosure is described in detail above in connection with a right angle connector, it should be appreciated that the present disclosure is also applicable to vertical connectors and other suitable types of electrical connectors. Unlike the right angle connector, in a vertical connector, a socket is formed in a top face of the front housing member opposite to a bottom face (in other words, in a vertical connector, an interfacing face is provided opposite to a mounting surface), and terminals of the vertical connector are configured such that contact portions of the terminals are accessible via the socket. The vertical connector may also be used to connect a second electronic system, such as a daughter card, to a first electronic system, such as a mother board. In some examples, the vertical connector may be configured for mounting to the first electronic system, such as a motherboard, such that the tail portions of the terminals of the vertical connector are electrically connected to the conductive portions (for example, conductive traces) of the first electronic system. The second electronic system, such as a daughter card, may be inserted into the socket such that the conductive portions of the second electronic system are disposed in contact with the contact portions of the corresponding terminals. In this way, the conductive portions of the second electronic system may be electrically connected to the corresponding conductive portions of the first electronic system via the terminals of the vertical connector, thereby establishing an electrical connection between the second electronic system and the first electronic system. The first electronic system and the second electronic system may communicate with each other by transmitting signals using the vertical connector using a standardized protocol, such as a PCI protocol.

It should also be appreciated that the terms "first" and "second" are only used to distinguish an element or component from another element or component, and that these elements and/or components should not be limited by the terms.

The present disclosure has been described in detail in conjunction with specific embodiments. Obviously, the above description and the embodiments shown in the appended drawings should be understood to be exemplary and do not constitute a limitation on the present disclosure. For a person skilled in the art, various variations or modifications can be made without departing from the spirit of the present disclosure, and these variations or modifications fall within the scope of the present disclosure.

What is claimed is:

1. An electrical connector, comprising:

a front housing member;

a cover member mounted to a rear of the front housing member;

a plurality of terminals arranged in the front housing member; and a bridging member comprising portions extending through the cover member and engaging a subset of the plurality of terminals, wherein:

each terminal of the subset of the plurality of terminals comprises a contact portion, a tail portion, and a body portion extending between the contact portion and the tail portion, for each terminal of the subset of the plurality of terminals, an accommodation space is disposed adjacent the body portion, and the terminals of the subset of the plurality of terminals comprise protruding portions extending from the body portions of the terminals into respective accommodation spaces.

2. The electrical connector of claim 1, wherein the bridging member provides a conductive or partially conductive path among ground terminals of the plurality of terminals.

3. The electrical connector of claim 1, wherein the bridging member is made of an electrically lossy material.

4. The electrical connector of claim 1, wherein the plurality of terminals are arranged in two terminal rows mutually opposed and spaced apart, with the terminals in each of the terminal row aligned therein.

5. The electrical connector of claim 4, wherein the two terminal rows are spaced apart in a manner that the terminals are offset from each other or aligned with each other along an arrangement direction.

6. The electrical connector of claim 1, wherein a dimension of the accommodation space matches with a cross-sectional dimension of the cover member such that the cover member can be received in the accommodation space.

7. The electrical connector of claim 6, wherein the cover member is fused to the front housing member and retains the at least a portion of the plurality of terminals in the front housing member.

8. The electrical connector of claim 1, wherein:

the cover member comprises a recess, and the bridging member is disposed in the recess such that an outer surface of the cover member is approximately flush with an outer surface of the front member.

9. An electrical connector, comprising:

a front housing member;

a plurality of terminals disposed in a row in the front housing member, the plurality of terminals each comprising a contact portion, a tail portion, a body portion extending between the contact portion and the tail portion, and an accommodation space in parallel to the body portion, the plurality of terminals comprising ground terminals comprising protrusion portions protruding into respective accommodation spaces; and a lossy member comprising slots receiving the protrusion portions of the ground terminals.

10. The electrical connector of claim 9, wherein:

the front housing member comprises top and bottom faces opposite each other, left and right side faces opposite each other, and front and rear side faces opposite each other, the front side face comprising a socket, the rear side face comprising a cavity, and the electrical connector comprises a cover member disposed in the cavity of the rear side face of the front housing member and fused to the front housing member.

11. The electrical connector of claim 10, wherein:

the cover member comprises slots, and the slots of the lossy member are accessible via the slots of the cover member.

12. The electrical connector of claim 11, wherein the protruding portions of the ground terminals protrude into the slots of the cover member.

13. The electrical connector of claim 9, wherein:

the lossy member comprises a plurality of pairs of ribs, and the slots of the lossy member are between pairs of the plurality of pairs of ribs.

14. The electrical connector of claim 13, wherein:

the protruding portions of the ground terminals are sandwiched between respective pairs of the plurality of pairs of ribs whereby the ground terminals are connected to the lossy member.

15. The electrical connector of claim 10, wherein the cover member comprises a recess for receiving the lossy member.

16. A method of manufacturing an electrical connector comprising a plurality of terminals each comprising a contact portion, a tail portion, and a body portion extending between the contact portion and the tail portion, the method comprising:

inserting the plurality of terminals into a front housing member through an opening in a rear of the front housing member, wherein the front housing member comprises a plurality of protrusions;

inserting a cover member into the opening in the rear of the front housing member and securing the cover member to the front housing member, wherein:

the cover member comprises a plurality of slots, and inserting the cover member into the opening in the rear of the front housing member comprises inserting the plurality of protrusions of the front housing member into the plurality of slots of the cover member; and filling a cavity of the cover member with lossy material.

17. The method of claim 16, wherein:

for each of the at least a portion of the plurality of terminals, an accommodation space forms adjacent the body portion.

18. The method of claim 17, wherein:

the plurality of terminals comprises signal terminals and ground terminals, the ground terminals form the subset of the plurality of terminals, and the ground terminals comprise protruding portions extending from the body portions of the ground terminals into respective accommodation spaces.

19. The method of claim 16, wherein:

the cover member is secured to the front housing member by a hot melt process for forming a hot melt bar.

20. The method of claim 16, wherein the filling the cavity of the cover member with the lossy material comprises before or after the cover member is attached, molding the lossy material into the cavity, or inserting a member molded from the lossy material into the cavity.

* * * * *